US010174981B2

(12) United States Patent
Yashar

(10) Patent No.: US 10,174,981 B2
(45) Date of Patent: Jan. 8, 2019

(54) ICEMAKER, PROCESS FOR CONTROLLING SAME AND MAKING ICE

(71) Applicant: NATIONAL INSTITUTE OF STANDARDS AND TECHNOLOGY, Gaithersburg, MD (US)

(72) Inventor: David Yashar, Dunn Loring, VA (US)

(73) Assignee: NATIONAL INSTITUTE OF STANDARDS AND TECHNOLOGY, Gaithersburg, MD (US)

( * ) Notice: Subject to any disclaimer, the term of this patent is extended or adjusted under 35 U.S.C. 154(b) by 675 days.

(21) Appl. No.: 14/480,708

(22) Filed: Sep. 25, 2014

(65) Prior Publication Data

US 2015/0007590 A1 Jan. 8, 2015

Related U.S. Application Data

(60) Provisional application No. 61/915,190, filed on Dec. 12, 2013.

(51) Int. Cl.
*F25C 1/00* (2006.01)
*F25D 29/00* (2006.01)

(52) U.S. Cl.
CPC ..... *F25C 1/00* (2013.01); *F25D 29/00* (2013.01); *F25C 2600/04* (2013.01)

(58) Field of Classification Search
CPC ..... F25C 2600/02; F25C 2600/04; F25C 2400/10; F25C 5/08
See application file for complete search history.

(56) References Cited

U.S. PATENT DOCUMENTS 4,328,681 A * 5/1982 Sakamoto ..... F25C 1/147 62/157
4,424,683 A * 1/1984 Manson ..... F25C 1/04 62/135
5,218,830 A * 6/1993 Martineau ..... F25C 5/10 62/160
6,655,158 B1 * 12/2003 Wiseman ..... F25C 5/187 62/353
6,679,073 B1 * 1/2004 Hu ..... F25C 5/08 62/135

(Continued)

OTHER PUBLICATIONS

Yashar, David. "Development of a Method to Measure the Energy Consumption of Automatic Icemakers in Domestic Refrigerators with Single Speed Compressors" NIST Technical Note 1759, Sep. 2012. http://dx.doi.org/l 0.6028/NIST.TN.l759.

*Primary Examiner* — Marc E Norman
*Assistant Examiner* — Nelson J Nieves
(74) *Attorney, Agent, or Firm* — Office of Chief Counsel for National Institute of Standards and Technology

(57) ABSTRACT

A system to make ice includes a refrigeration unit and an icemaker disposed in the refrigeration unit. The refrigeration unit is configured to be subjected to a refrigeration cycle; the icemaker is configured to be subjected to a freeze cycle; and the system is configured such that the freeze cycle is synchronized with the refrigeration cycle, asynchronized with the refrigeration cycle, or a combination comprising at least one of the foregoing. A process for controlling an icemaker includes providing a freeze cycle to an icemaker; providing a refrigeration cycle to a refrigeration unit; and constraining the freeze cycle and the refrigeration cycle to control the icemaker.

3 Claims, 23 Drawing Sheets

(56) References Cited

U.S. PATENT DOCUMENTS

| | | | | |
|---|---|---|---|---|
| 7,062,936 | B2 * | 6/2006 | Rand | F25B 5/04 62/347 |
| 2005/0109056 | A1 * | 5/2005 | Rand | F25B 5/04 62/340 |
| 2005/0155360 | A1 * | 7/2005 | Yoshida | F25C 1/12 62/135 |
| 2006/0260345 | A1 * | 11/2006 | Coulter | F25D 11/02 62/340 |
| 2006/0266056 | A1 * | 11/2006 | Chang | F25C 5/02 62/135 |
| 2006/0266059 | A1 * | 11/2006 | Wetekamp | F25C 5/005 62/187 |
| 2007/0157636 | A1 * | 7/2007 | Billman | F25C 1/12 62/73 |
| 2009/0293508 | A1 * | 12/2009 | Rafalovich | F25C 5/005 62/66 |
| 2010/0101244 | A1 * | 4/2010 | Yoshida | F25C 1/225 62/66 |
| 2010/0292846 | A1 * | 11/2010 | Lee | F25C 1/00 700/275 |
| 2012/0000216 | A1 * | 1/2012 | Kim | F25C 1/00 62/66 |
| 2012/0285187 | A1 * | 11/2012 | Sugaya | F25C 5/08 62/137 |
| 2012/0291469 | A1 * | 11/2012 | Li | F25D 29/00 62/186 |
| 2013/0025303 | A1 * | 1/2013 | Yoon | F25B 49/022 62/89 |
| 2015/0096310 | A1 * | 4/2015 | Wait | F25C 1/147 62/66 |

* cited by examiner

ICEMAKER, PROCESS FOR CONTROLLING SAME AND MAKING ICE

CROSS REFERENCE TO RELATED APPLICATIONS

This application claims the benefit of U.S. Provisional Patent Application Ser. No. 61/915,190 filed Dec. 12, 2013, the disclosure of which is incorporated herein by reference in its entirety.

STATEMENT REGARDING FEDERALLY SPONSORED RESEARCH

This invention was made with United States government support from the National Institute of Standards and Technology. The government has certain rights in the invention.

BACKGROUND

Domestic refrigerating appliances typically maintain a low temperature within a cabinet. Automatic icemakers installed in a low temperature compartment of domestic refrigerating appliances are connected to a source of water, produce ice, and store ice in a bin. Their operation includes cycling a series of steps independently from the refrigerating appliance's cooling cycle. However, such operation has limited efficiency.

Accordingly, increasing efficiency of operating a refrigeration appliance would be well-received in the art.

BRIEF DESCRIPTION

The above and other deficiencies are overcome by, in an embodiment, a system to make ice comprising: a refrigeration unit; and an icemaker disposed in the refrigeration unit, wherein the refrigeration unit is configured to be subjected to a refrigeration cycle; the icemaker is configured to be subjected to a freeze cycle; and the system is configured such that the freeze cycle is synchronized with the refrigeration cycle, asynchronized with the refrigeration cycle, or a combination comprising at least one of the foregoing.

Further disclosed is a process for controlling an icemaker, the process comprising: providing a freeze cycle to an icemaker; providing a refrigeration cycle to a refrigeration unit; and constraining the freeze cycle and the refrigeration cycle to control the icemaker.

Additionally disclosed is a process for making ice, the process comprising: providing a refrigeration cycle to a refrigeration unit; providing a freeze cycle to an icemaker, the icemaker comprising: a receptacle to contain a fluid; and an extractor to extract ice from the receptacle, and the freeze cycle comprising: an extraction period; and a fill period; synchronizing the freeze cycle with the refrigeration cycle; disposing a fluid in the fluid receptacle during the fill period; freezing the fluid in the fluid receptacle to form an ice; and extracting the ice from the receptacle, during the extraction period, to make ice.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments is presented herein by way of exemplification and not limitation.

It has been found that a system that includes refrigeration unit and icemaker has improved power efficiency for making ice when a freeze profile of the icemaker is constrained with a refrigeration profile of the refrigeration unit as compared with operating the system with the freeze profile independent of the refrigeration profile.

Figure 1:
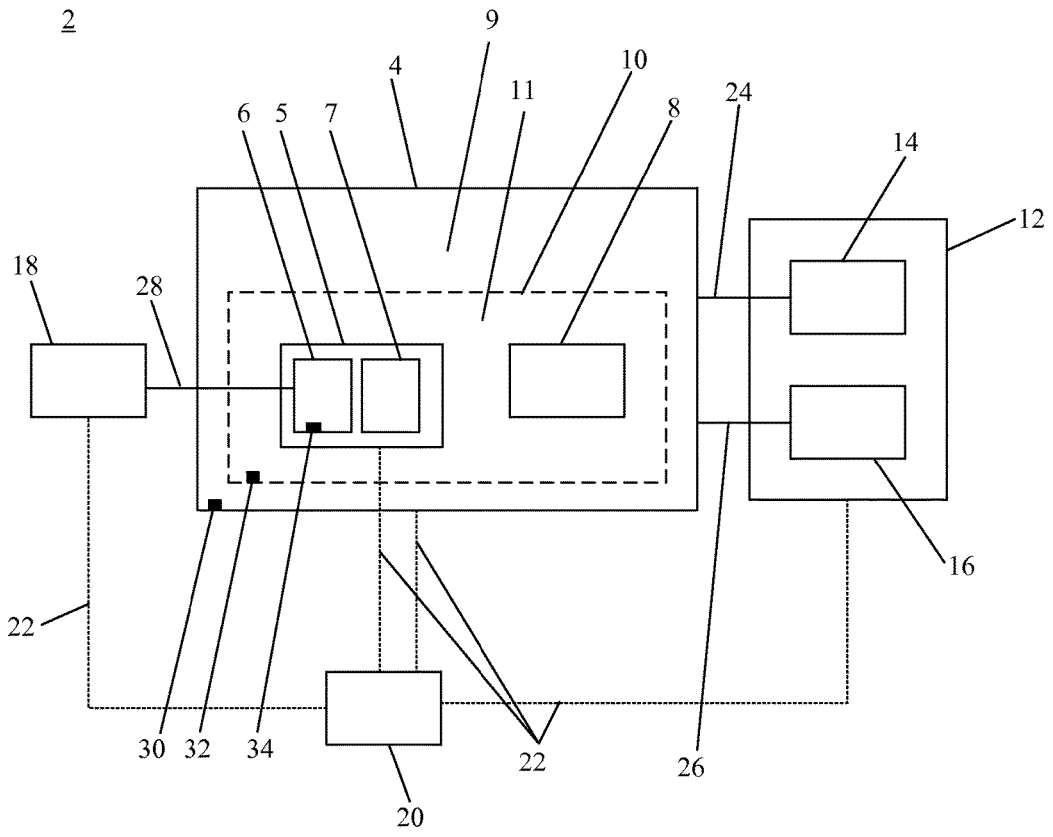
FIG. 1 shows a system that includes a refrigeration unit.

According to an embodiment, as shown in FIG. 1, system 2 includes icemaker 5 disposed in refrigeration unit 4. Icemaker 5 includes fluid receptacle 6 (e.g., a mold) to receive a fluid and to contain the fluid as the fluid is cooled from a liquid state to a frozen state, referred to herein as ice. Additionally, icemaker 5 includes an extractor 7 configured to extract ice from fluid receptacle 6. Extractor 7 can include a heater to heat fluid receptacle 6, a mechanical member to deform (e.g., bend, twist, or cause other deformation of fluid receptacle 6) fluid receptacle 6, or combination thereof ice from fluid receptacle 6 can be disposed in container 8.

In some embodiments, icemaker 5 is disposed in compartment 10 such that compartment 10 partitions refrigeration unit 4 into first portion 9 and second portion 11. Additionally, refrigeration unit 4 can include a plurality of temperature sensors to measure a temperature of refrigeration unit 4. First temperature sensor 30 is disposed in first portion 9 to measure a temperature of first portion 9. Second temperature sensor 32 is disposed in second portion 11 to measure a temperature of second portion 11 (referred to as compartment temperature TC). Third temperature sensor 34 is disposed in thermal contact with fluid receptacle 6 to measure a temperature of fluid receptacle 6. Here, second portion 11 can have compartment temperature TC that is greater than or equal to a temperature of first portion 9. It is contemplated that in some embodiments compartment 10 is absent so that refrigeration unit 4 is not partitioned into a plurality of portions and includes only the first portion 9. As such, first temperature sensor 30 is disposed in thermal contact with an interior of refrigeration unit 4, and the interior has substantially uniform temperature, e.g. compartment temperature TC.

Refrigeration system 12 includes compressor 14 and fan 16. Fluid path 24 connects compressor 14 with refrigeration unit 4 and provides fluid communication therebetween. Similarly, path 26 connects fan 16 with refrigeration unit 4 to provide fluid communication therebetween. In this manner, refrigeration system 12 withdraws heat from inside refrigeration unit 4 to lower an internal temperature of refrigeration unit 4, e.g., compartment temperature TC.

Fluid source 18 provides fluid via path 24 to fluid receptacle 6. The fluid received by fluid receptacle 6 is subjected to freezing and forming ice by removing heat from the fluid by icemaker 5 via heat transfer from the fluid and fluid receptacle 6. In this regard, the fluid is a liquid that can be frozen in fluid receptacle 6. Exemplary fluids include water, alcohols, glycols, organic fluids, inorganic fluids, and the like.

Controller 20 controls operation of icemaker 5, refrigeration system 12, or fluid source 18. A plurality of control signals are transmitted from controller 20 via a plurality of control paths 22. Control path 22 can be hardwired (e.g., by wire, cable, and the like) or wireless. Exemplary control signals include a digital signal, analog signal, or combination thereof. Further, the control signal can be a continuous wave or modulated control signal. Controller 20 also can monitor the status of icemaker 5, refrigeration system 12, or fluid source 18 or receive temperature information from the plurality of temperature sensors 30, 32, 34. According to an embodiment, controller 20 controls provision of fluid from fluid source 18 to icemaker 5. In an embodiment, controller 20 controls refrigeration system 12, which control can be based, e.g., on a condition such as a temperature of refrigeration unit 4, compartment 10 (e.g., compartment temperature TC), icemaker 5, a timer, and the like.

In an embodiment, refrigeration unit 4, refrigeration system 12, fluid source 18, and controller 20 are arranged in a single article. In a certain embodiment, refrigeration system 12, fluid source 18, or controller 20 remotely connects or communicates with refrigeration unit 4. According to an embodiment, controller 20 receives an input from an external source (not shown), and controller 20 provides a control signal to refrigeration unit 4, refrigeration system 12, icemaker 5, or fluid source 18 based on the input received from the external source. Exemplary inputs include a logic signal, timer value, timing sequence, and the like.

Refrigeration unit 4 includes a plurality of thermally insulating walls to maintain a temperature inside refrigeration unit 4. Fluid receptacle 6 can be made of a material that is rigid to resist deformation or that is flexible with regard to deformation by extractor 7. In an embodiment, fluid receptacle 6 includes plastic, metal, ceramic, or combination thereof. Further, fluid receptacle 6 communicates heat from the fluid disposed therein will so that the fluid freezes to form ice.

Figure 12:
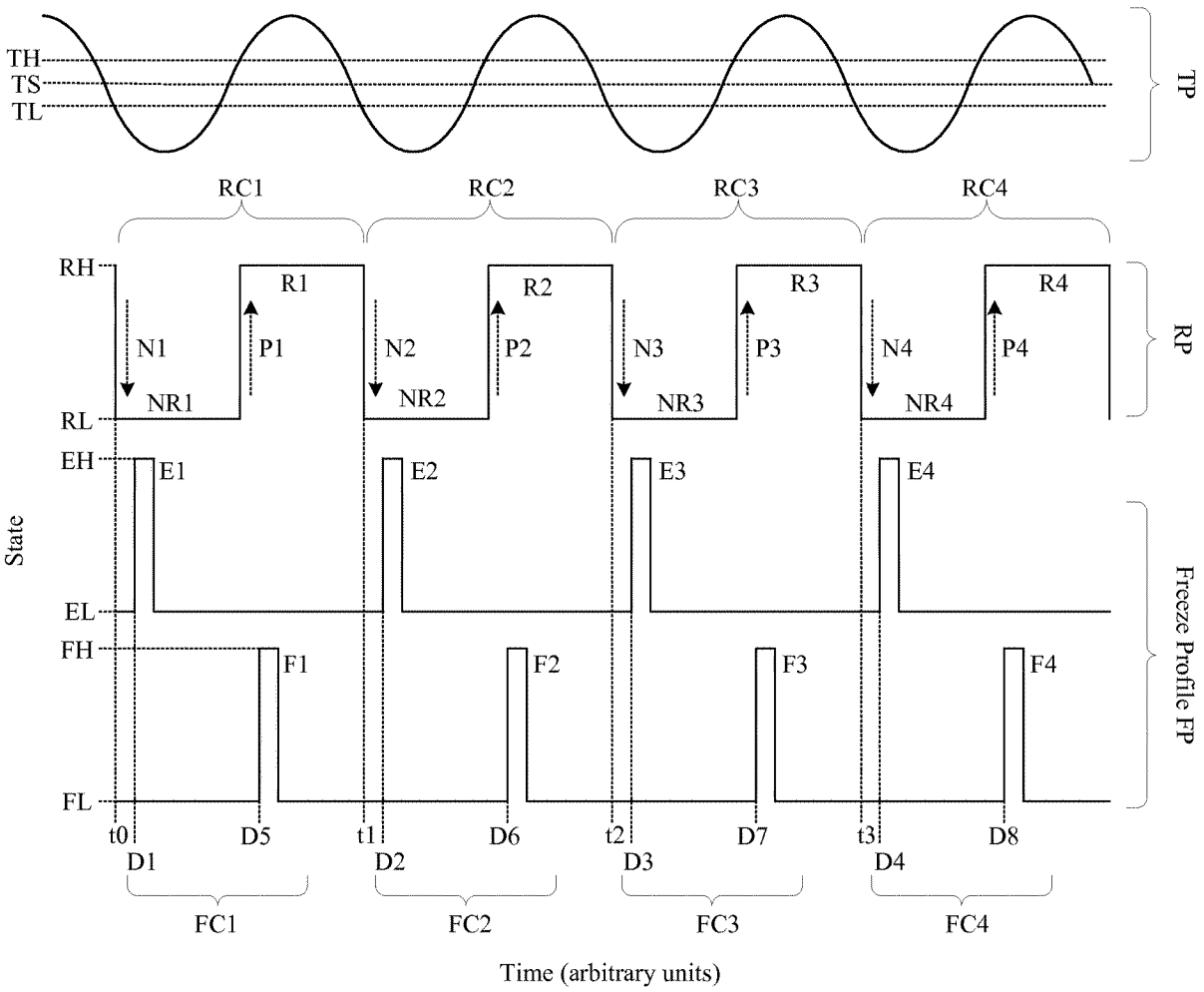

According to an embodiment, refrigeration unit 4 is subjected to cooling (i.e., heat removal) by refrigeration system 12. Accordingly, as shown in FIG. 12, refrigeration unit 4 exhibits temperature profile TP in response to a variation of temperature in refrigeration unit 4 due to cooling by refrigeration system 12. Controller 20 controls refrigeration system 12 based on temperature profile TP, which includes set temperature TS, temperature high level TH, and temperature low level TL. To maintain refrigeration unit 4 at set temperature TS, controller 20 provides a control signal to refrigeration system 12 such that refrigeration system 12 operates to cool refrigeration unit 4 so that temperature profile TP have a maximum temperature near temperature high level TH and a minimum temperature near low temperature TL. Under control of controller 20, refrigeration system 12 provides refrigeration profile RP to refrigeration unit 4, particularly icemaker 5 to freeze the fluid from a liquid to ice. Refrigeration profile RP is a waveform that includes refrigeration high level RH and refrigeration low level RL, corresponding to refrigeration system 12 controlled by controller 20 to be ON (i.e., RH) and OFF (i.e., RL). Here, refrigeration profile RP is constrained to temperature profile TP. That is, refrigeration profile RP includes a plurality of refrigeration cycles (e.g., first refrigeration cycle RC1, second refrigeration cycle RC2, and the like) that are coincident temporally with a specific temperature of temperature profile TP. The refrigeration cycles include a non-refrigeration period NR, refrigeration period R, negative transition N from refrigeration high level RH to refrigeration low level RL, and positive transition from refrigeration low level RL to refrigeration high level RH. Hence, first refrigeration cycle RC1 includes first non-refrigeration period NR1 that starts at time t0 when refrigeration profile RP exhibits first negative transition N1 coincident with temperature profile TP obtaining temperature low level TL (as temperature profile TP decreases from set temperature TS to temperature low level TL). During first non-refrigeration period NR1, controller 20 controls refrigeration system 12 to be in an off state such that refrigeration system 12 does not withdraw heat from refrigeration unit 4. It is contemplated that, although refrigeration system 12 as an off state, temperature profile TP can exhibit a decreasing temperature immediately after time t0 before temperature profile TP obtains a minimum temperature and starts to increase toward set temperature TS. First refrigeration cycle RC1 also includes first refrigeration period R1 that starts at time t1 when refrigeration profile RP exhibits first positive transition P1 coincident with temperature profile TP obtaining temperature high level TH (as temperature profile increases from set temperature TS to temperature high level TH). During first refrigeration period R1, controller 20 controls refrigeration system 12 to be in an on state such that refrigeration system 12 withdraws heat from refrigeration unit 4. It is contemplated that, although refrigeration system 12 is in an on state, temperature profile TP can exhibit an increasing temperature immediately after time t1 before temperature profile TP obtains a maximum temperature and starts to decrease towards set temperature TS.

Additionally, refrigeration profile RP includes second refrigeration cycle RC2 that includes second non-refrigeration period NR2 and second refrigeration period R2 that respectively start at times t2 and t3 and occur respectively after second negative transition N2 and second positive transition P2. Second negative transition N2 temporally coincides with temperature profile TP obtaining temperature low level TL as temperature profile TP decreases from set temperature TS. Second positive transition P2 temporally coincides with temperature profile TP obtaining temperature high level TH as temperature profile TP increases from set temperature TS.

Figure 2:
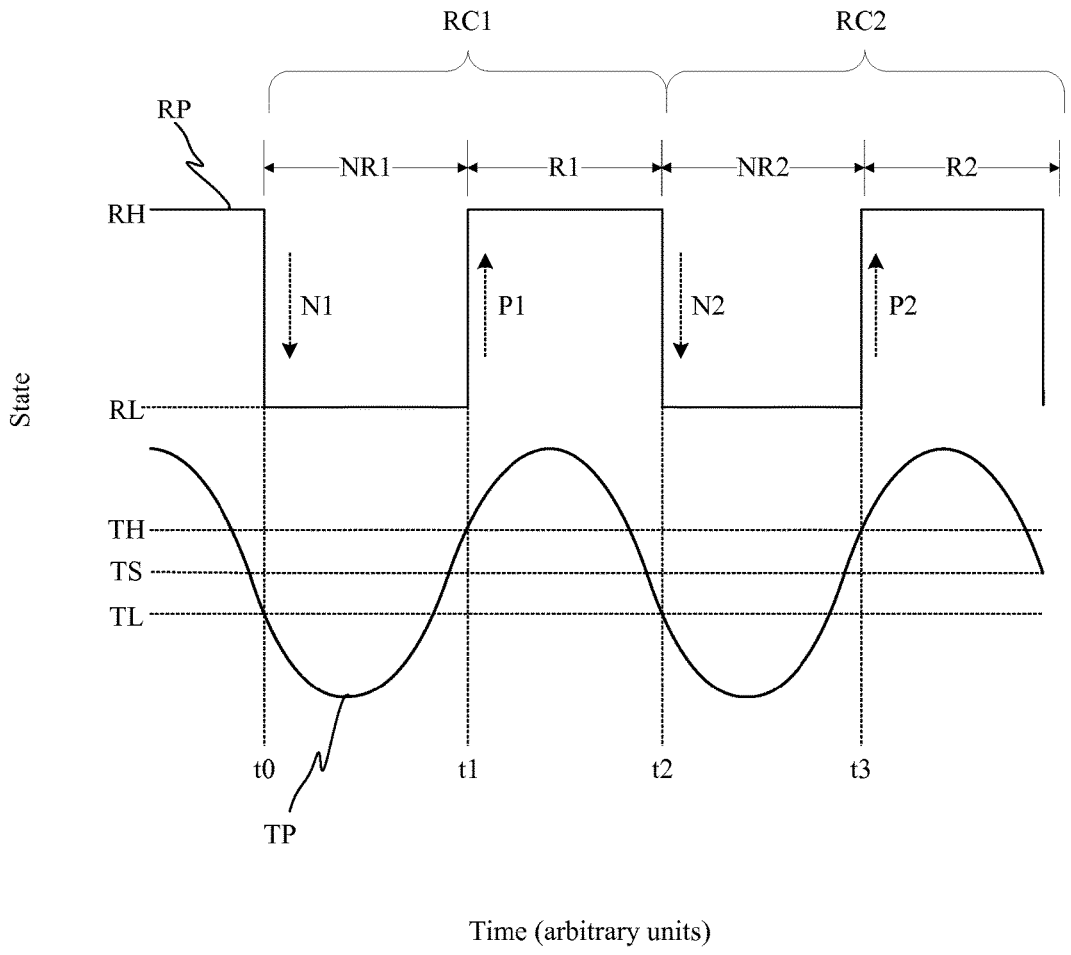
FIG. 2 shows a graph of state versus time for a refrigeration profile constrained to a temperature profile.

As shown in FIG. 2, refrigeration profile RP is constrained to temperature profile TP of refrigeration unit 4. As used herein, "constrained" refers to temporally timing a second waveform to a first waveform. In contrast, "unconstrained" refers to a second waveform being independent of the first waveform. For a second waveform constrained to a first waveform, the second waveform is synchronous to the first waveform or asynchronous to the first waveform. As used herein, "synchronous" (and other forms of "synchronous" such as synchronously, synchronized, synchronizing, to synchronize, and the like) refers to a situation wherein, with respect to an amplitude of a first waveform and a second waveform, a high level of the first waveform overlaps with a high level of the second waveform or a low level of the first waveform overlaps width and low level of the second waveform. As used herein, "asynchronous" (and other forms of "asynchronous" such as asynchronously, asynchronized, asynchronizing, to asynchronize, and the like) refers to a situation wherein, with respect to amplitudes of the first waveform and the second waveform, a low level of the first waveform overlaps with a high level of the second waveform.

Figure 3:
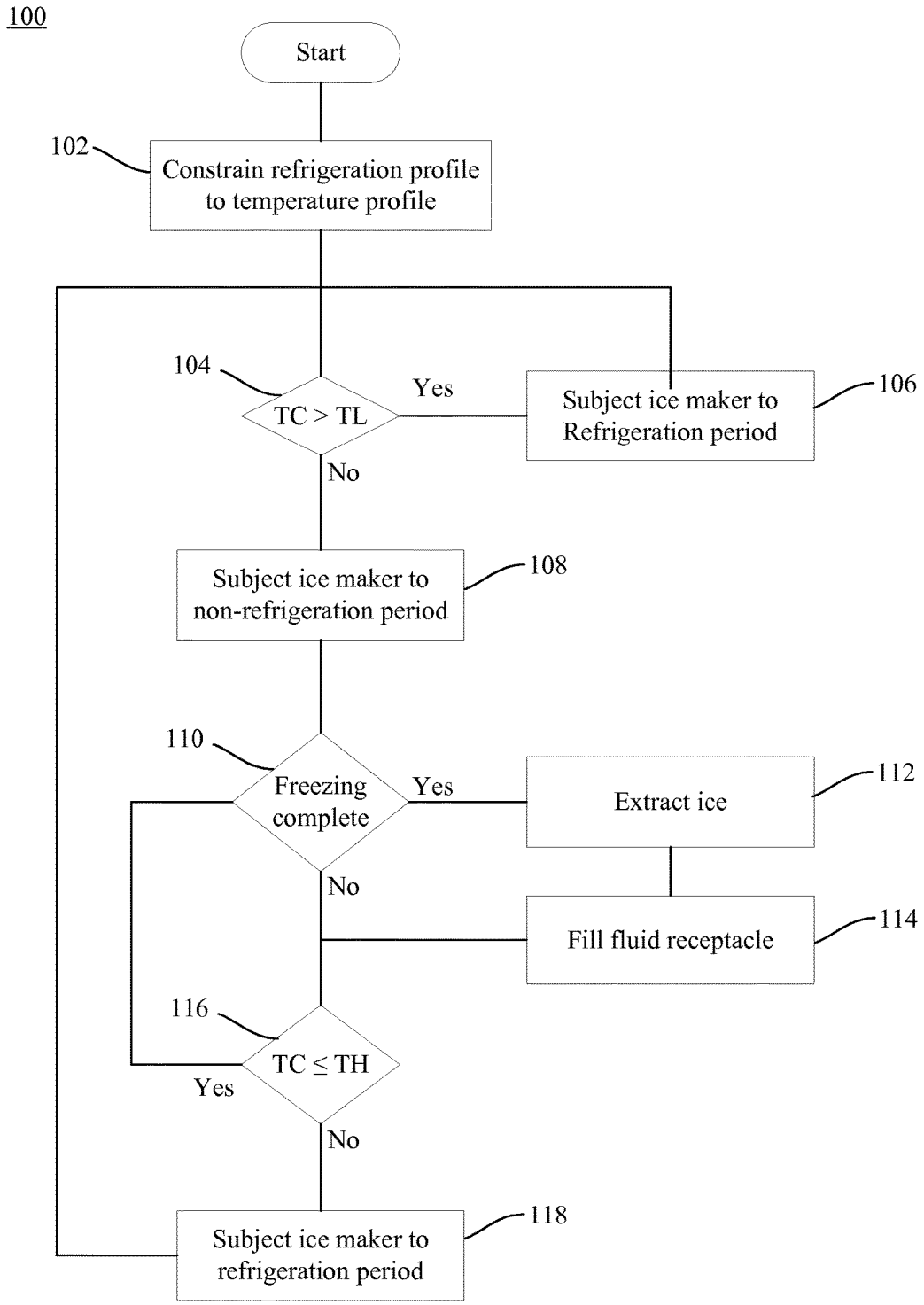
FIG. 3 shows a flow diagram for controlling an icemaker.

In an embodiment, controller 20 includes control logic for controlling refrigeration system 12 on and off to maintain a temperature inside refrigeration unit 4 around set temperature TS. With reference to FIG. 3, which shows a flow diagram for controlling an icemaker to make ice, the process includes constraining refrigeration profile RP to temperature profile TP (step 102), obtaining compartment temperature TC, comparing compartment temperature TC to temperature low level TL, and determining whether compartment temperature TC is greater than temperature low level TL (step 104). If no compartment temperature TC is greater than temperature low level TL, then icemaker 5 is subjected to refrigeration period RP. During non-refrigeration period NR, controller 20 determines, e.g., from temperature data from temperature sensor 34, whether the fluid in the fluid receptacle 6 has formed ice completely (step 110). If freezing is complete (step 110), the ice is extracted from the fluid receptacle 6 by extractor 7 (step 112), then fluid receptacle 6 receives fluid, e.g., from fluid source 18 (step 114). The process includes repetitively determining whether freezing is complete in fluid receptacle 6 and provides extraction of ice (step 112) and filling fluid receptacle 6 (step 114) as long as compartment temperature TC is less than or equal to temperature high level TH (step 116). When compartment temperature TC is greater than temperature high level TH (step 116), icemaker 5 is subjected to refrigeration period RP (step 118). Thereafter, compartment temperature TC is compared to temperature low level TL (step 104).

According to an embodiment, a system to make ice includes a refrigeration unit and an icemaker disposed in the refrigeration unit, wherein the refrigeration unit is configured to be subjected to a refrigeration profile; the icemaker is configured to be subjected to a freeze profile; and the system is configured such that the freeze profile is synchronized with the refrigeration profile, asynchronized with the refrigeration profile, or a combination comprising at least one of the foregoing. In an embodiment, the system consumes less energy when the freeze profile is asynchronous with the refrigeration profile than when the freeze profile is independent of the refrigeration profile. In a certain embodiment, the system consumes less energy when the freeze profile is synchronous with the refrigeration profile than when the freeze profile is independent of the refrigeration profile. In a particular embodiment, the system consumes less energy when the freeze profile is asynchronous with the refrigeration profile than when the freeze profile is synchronous with the refrigeration profile.

Figure 4:
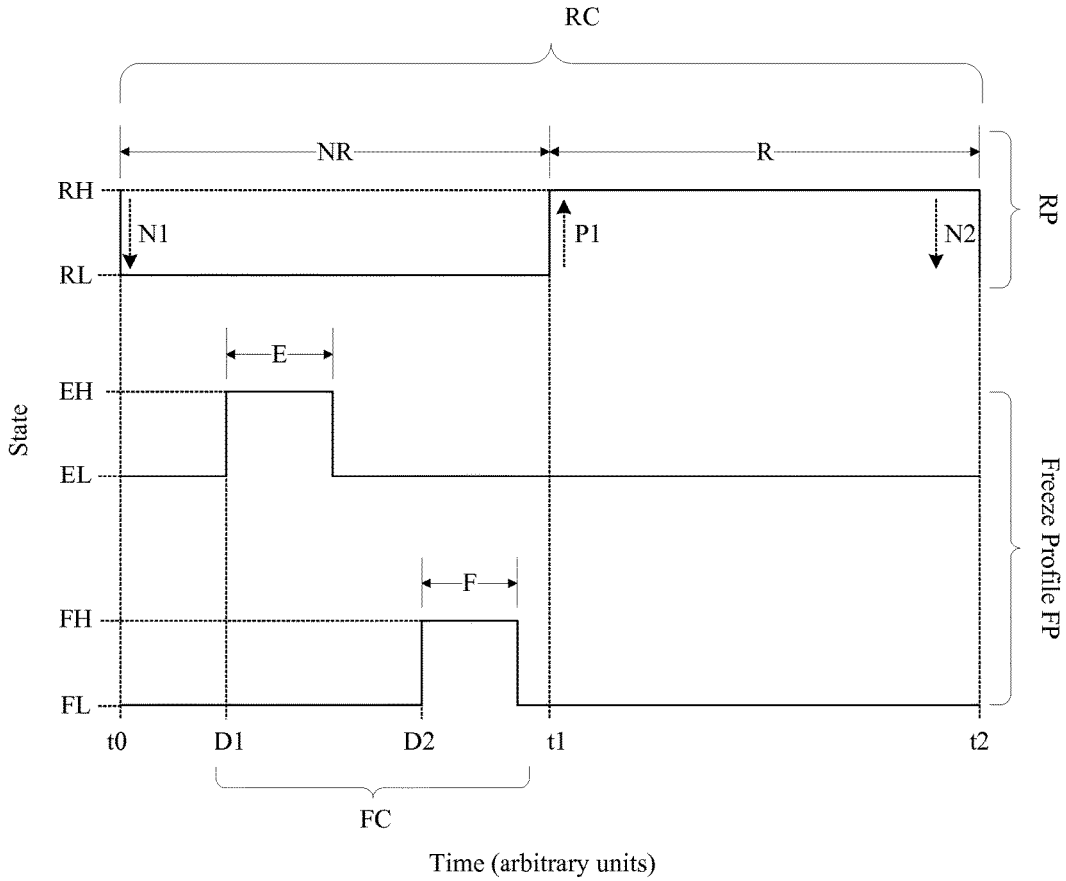
FIG. 4 shows a graph of state versus time for a fill cycle that is synchronous with a refrigeration cycle.

In an embodiment, icemaker 5 is subjected to a freeze profile FP that is constrained to refrigeration profile RP, to which refrigeration unit 4 is subjected. As shown in FIG. 4, freeze profile FP is constrained to refrigeration profile RP, and freeze profile FP includes freeze cycle FC having extraction period E and fill period F. During extraction period E, extractor 7 removes ice disposed in fluid receptacle 6. During fill period F, fluid is disposed in fluid receptacle 6 to form more ice. Here, freeze profile FP is asynchronously constrained to refrigeration cycle RC such that, at time t0, refrigeration profile RP has first negative transition N1 from refrigeration high level RH to refrigeration low level RL, starting non-refrigeration period NR. After time delay D1, extraction period E begins and lasts for a selected time while ice is removed from fluid receptacle 6 by extractor 7. Freeze cycle FC continues by occurrence of fill period F after time delay D2 that lasts until fluid receptacle 6 is filled with fluid. At time t1, refrigeration profile RP has a first positive transition P1 from refrigeration low level RL to refrigeration high level RH, and refrigeration period R begins and lasts until second negative transition N2 at time t2.

Extraction period E occurs when controller 20 controls extractor 7 to extract ice from fluid receptacle 6, e.g., corresponding to a logic level at extractor high level EH. In contrast, extractor 7 does not extract ice when a logic level for extracting ice has a value of extractor low level EL. Similarly, fill period F occurs when controller 20 controls fluid source 18 to provide fluid to fluid receptacle 6, e.g., corresponding to a logic level at fill high level FH. Moreover, fluid source 18 does not provide fluid when a logic level for filling fluid receptacle 6 has a value of fill low level FL. Hence, extracting ice from and providing a fluid to fluid receptacle 6 can be controlled by a plurality of logic levels (e.g., EH, EL, FH, FL) respectively provided to extractor 7 and fluid source 18. Logic levels (e.g., EH, EL, FH, FL) can be provided from controller 20. Additionally, timing of logic levels EH, EL, FH, FL from controller 20 are controlled relative to a negative transition, positive transition, or combination thereof for refrigeration cycle RC to constrain freeze profile FP to refrigeration profile RP. It is contemplated that freeze cycle FC is synchronous or asynchronous (as in FIG. 4) to refrigeration period R.

Figure 5:
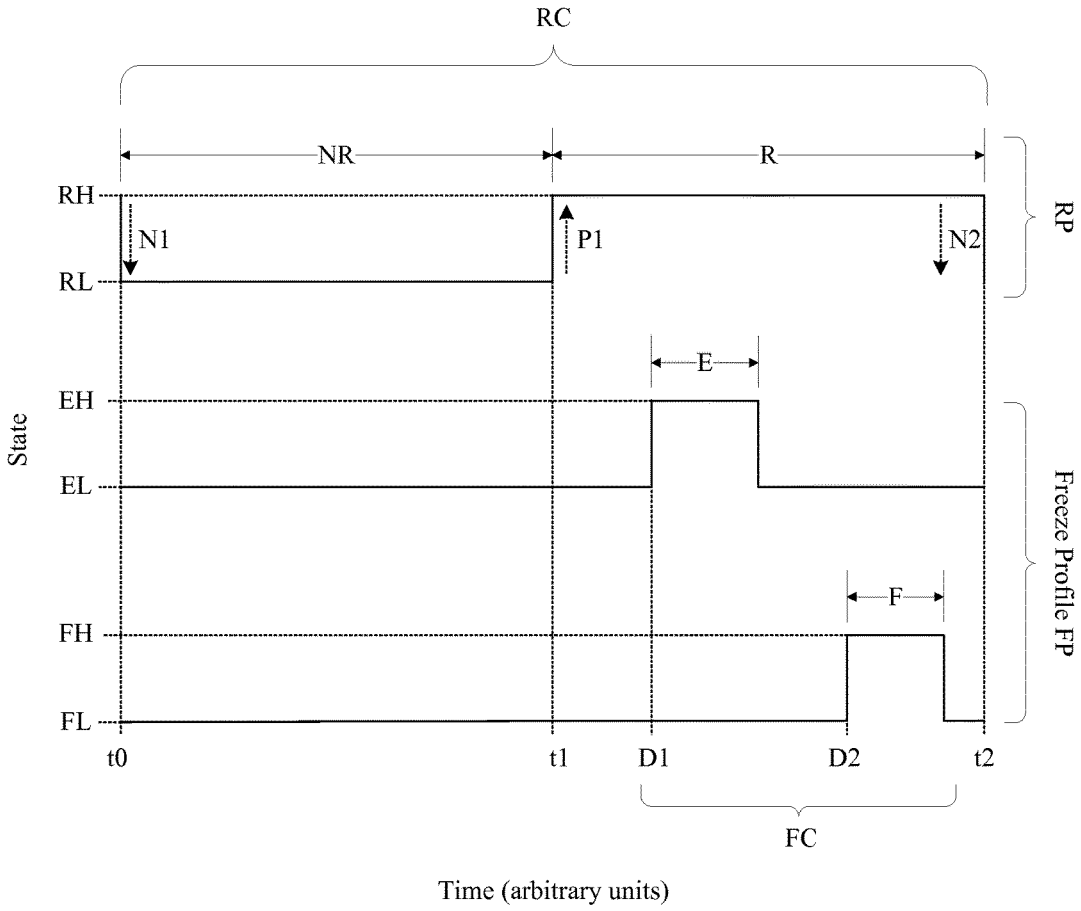
FIG. 5 shows a graph of state versus time for a fill cycle that is asynchronous with a refrigeration cycle.

According to an embodiment, as shown in FIG. 5, freeze cycle FC is constrained to be synchronous with refrigeration cycle RC. Here, refrigeration period R begins at first positive transition P1 at time t1 and lasts until second negative transition N2 at time t2. During refrigeration period R, fill cycle FC occurs and includes extraction period E after first time delay D1 and fill period F after second time delay D2. It will be appreciated that extraction period E and fill period F do not overlap.

Figure 6:
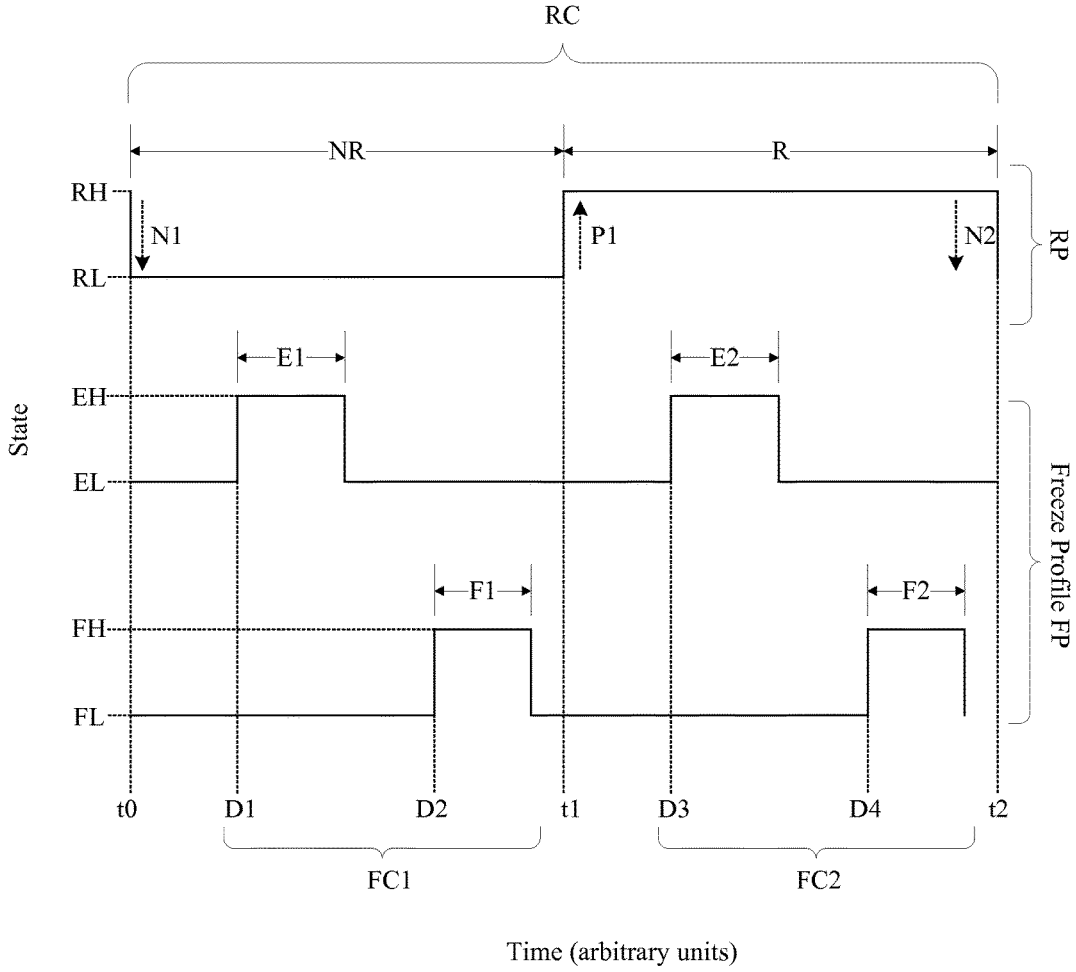
FIG. 6 shows a graph of state versus time for a plurality of fill cycles constrained to a refrigeration cycle.

In some embodiments, as shown in FIG. 6, freeze profile FP is constrained to refrigeration profile RP and includes a plurality of freeze cycles, e.g., first freeze cycle FC1 and second freeze cycle FC2. Here, first freeze cycle FC1 occurs during non-refrigeration period NR and is thus asynchronous to refrigeration period R during which second freeze cycle FC2 occurs. Accordingly, second freeze cycle FC2 is synchronous with refrigeration period R.

Figure 7:
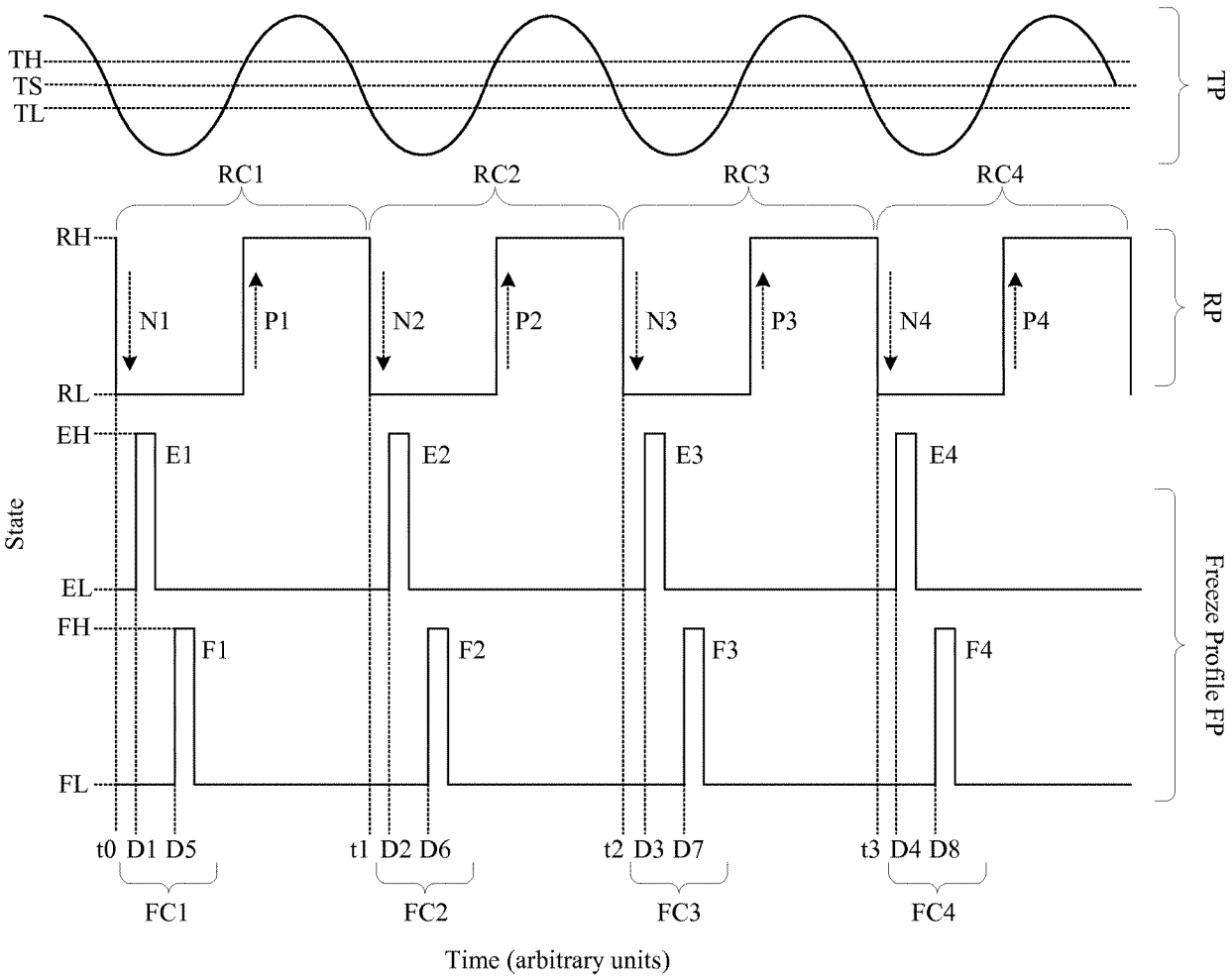
FIG. 7 shows a graph of state versus time for a plurality of fill cycles that is synchronous with a plurality of refrigeration cycles.

In an embodiment, as shown in FIG. 7, refrigeration profile RP is constrained to temperature profile TP, and freeze profile FP is constrained to temperature profile TP. Refrigeration profile RP includes a plurality of negative transitions (N1, N2, N3, N4), positive transitions (P1, P2, P3, P4), and refrigeration cycles (RC1, RC2, RC3, RC4). Negative transitions (N1, N2, N3, N4) temporally coincide with temperature profile TP obtaining a temperature value of temperature low level TL (decreasing from set temperature TS). Positive transitions (P1, P2, P3, P4) temporally coincide with temperature profile TP obtaining a temperature value of temperature high level TH (increasing from set temperature TS). Freeze profile FP includes a plurality of freeze cycles (FC1, FC2, FC3, FC4). Each freeze cycle (FC1, FC2, FC3, or FC4) respectively includes an extraction period (E1, E2, E3, or E4) and a fill period (F1, F2, F3, or F4). Here, freeze cycles (FC1, FC2, FC3, FC4) of freeze profile FP are asynchronously constrained with a corresponding refrigeration cycle (RC1, RC2, RC3, RC4) of refrigeration profile RP. That is, extraction period (E1, E2, E3, or E4) and fill period (F1, F2, F3, or F4) occur after a time delay (D1 and D5; D2 and D6; D3 and D7; or D4 and D8) with respect to negative transition (N1, N2, N3, or N4) at a time (t0, t1, t2, or t3) but before positive transition (P1, P2, P3, or P4). Thus, ice is extracted from fluid receptacle 6 during non-refrigeration periods (NR1, NR2, NR3, NR4) but not extracted during refrigeration periods (R1, R2, R3, R4). Furthermore, fluid is disposed in fluid receptacle 6 during non-refrigeration periods (NR1, NR2, NR3, NR4) but not disposed in fluid receptacle 6 during refrigeration periods (R1, R2, R3, R4).

Figure 8:
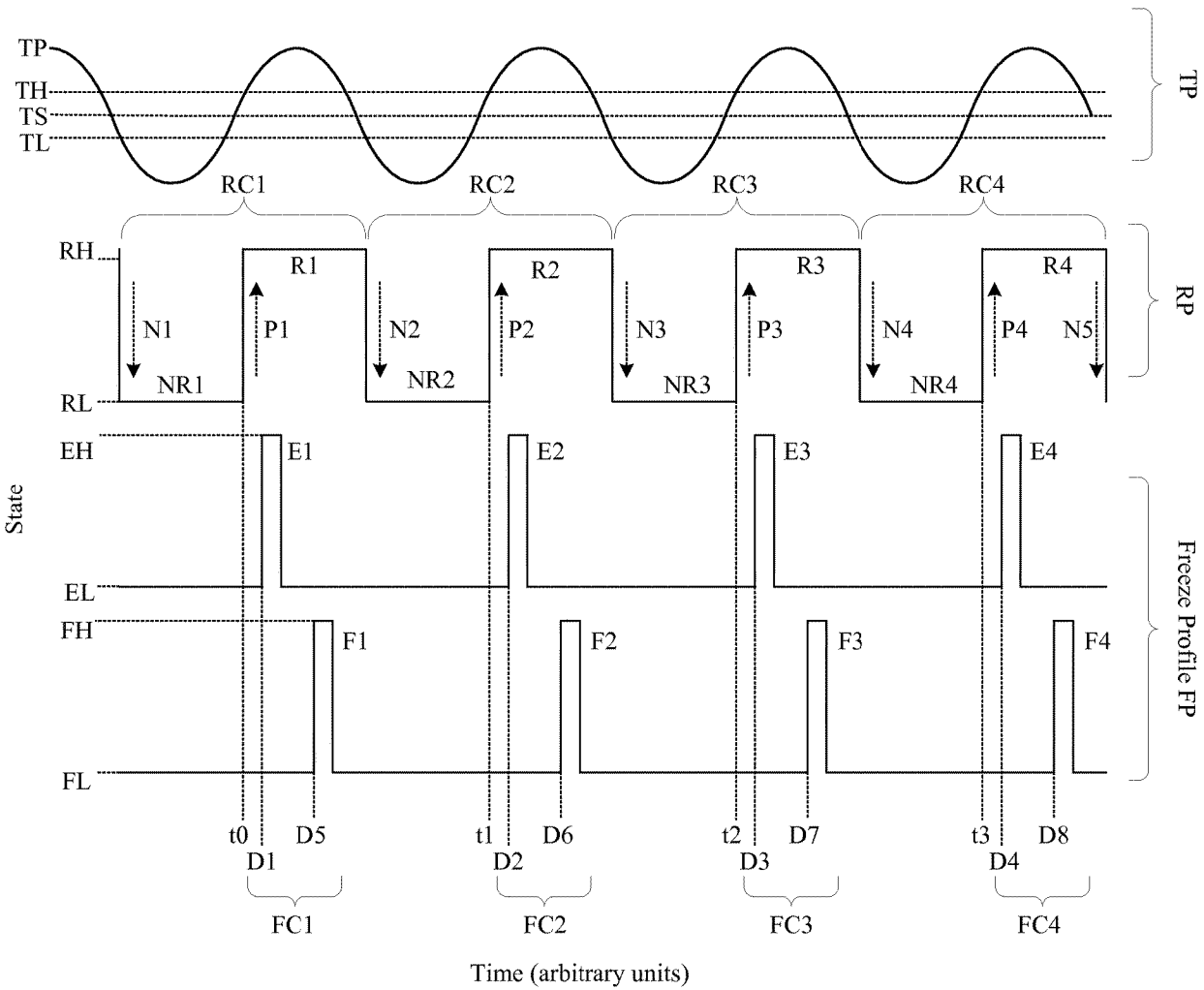
FIG. 8 shows a graph of state versus time for a plurality of fill cycles that is asynchronous with a plurality of refrigeration cycles.

In an embodiment, as shown in FIG. 8, refrigeration profile RP is constrained to temperature profile TP, and freeze profile FP is constrained to temperature profile TP. Here, freeze cycles (FC1, FC2, FC3, FC4) of freeze profile FP are synchronously constrained with a corresponding refrigeration cycle (RC1, RC2, RC3, RC4) of refrigeration profile RP. That is, extraction period (E1, E2, E3, or E4) and fill period (F1, F2, F3, or F4) occur after a time delay (D1 and D5; D2 and D6; D3 and D7; or D4 and D8) with respect to positive transition (P1, P2, P3, or P4) at a time (t0, t1, t2, or t3) but before negative transition (N1, N2, N3, or N4). Thus, ice is extracted from fluid receptacle 6 during refrigeration periods (R1, R2, R3, R4) but not extracted during non-refrigeration periods (NR1, NR2, NR3, NR4). Furthermore, fluid is disposed in fluid receptacle 6 during refrigeration periods (R1, R2, R3, R4) but not disposed in fluid receptacle 6 during the non-refrigeration periods (NR1, NR2, NR3, NR4).

Figure 9:
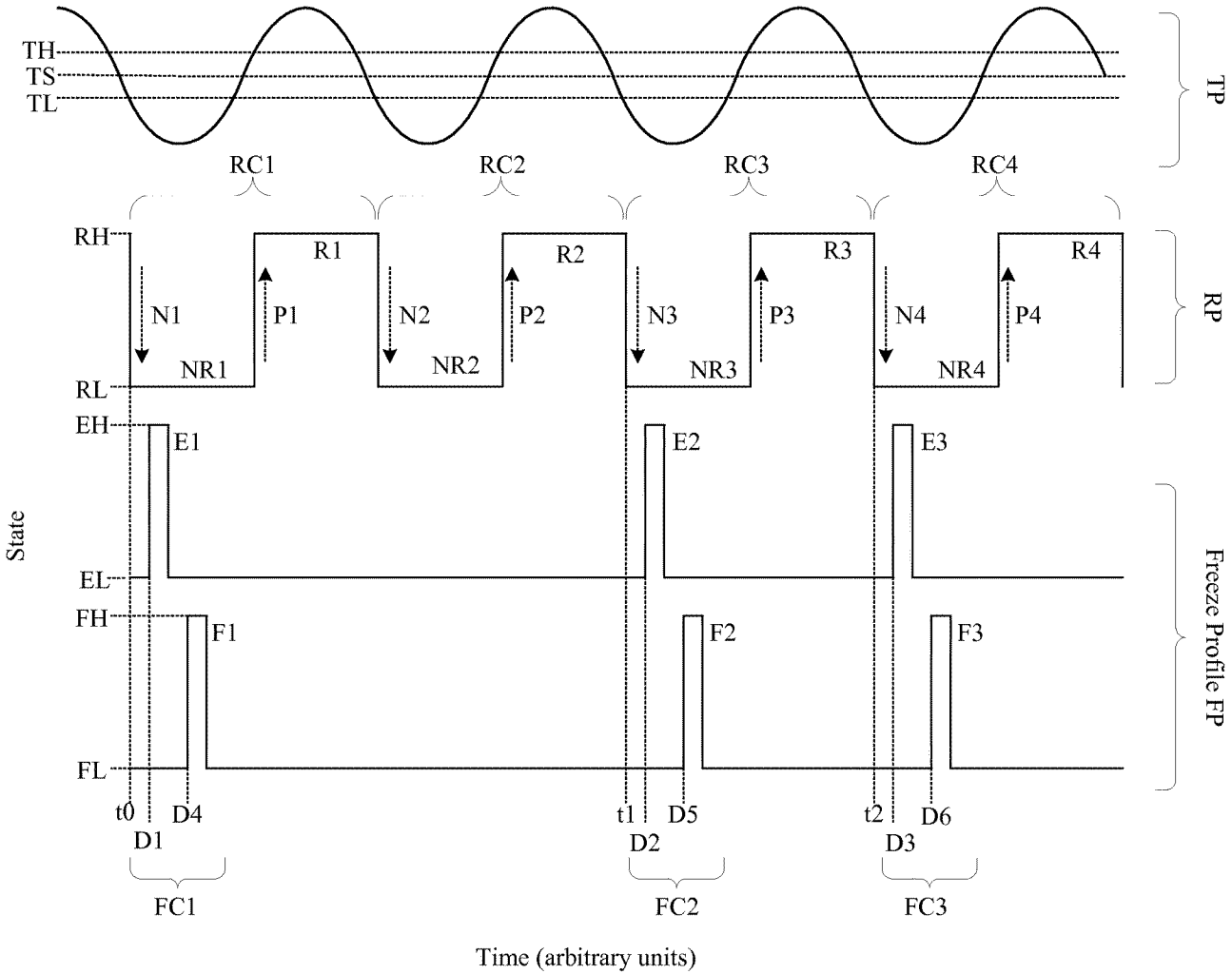
FIG. 9 shows a graph of state versus time for a plurality of fill cycles that is synchronous with a plurality of refrigeration cycles.

According to an embodiment, as shown in FIG. 9, refrigeration profile RP is constrained to temperature profile TP, and freeze profile FP is constrained to temperature profile TP. Here, freeze cycles (FC1, FC2, FC3) of freeze profile FP are asynchronously constrained with a corresponding refrigeration cycle (RC1, RC3, RC4) of refrigeration profile RP. During second refrigeration cycle RC2 (including second non-refrigeration period NR2 and second refrigeration period R2), freeze profile FP has extraction low level EL and fill low level FL such that ice is not extracted from fluid receptacle 6, and fluid source 18 does not dispose additional fluid and fluid receptacle 6. Accordingly, freeze profile FP includes a plurality of freeze cycles (FC1, FC2, FC3) that are asynchronously constrained with refrigeration cycles (RC1, RC3, RC4), and freeze profile FP provides for skipping a refrigeration cycle (e.g., RC2) for extracting ice from fluid receptacle 6 or for providing fluid to fluid receptacle 6.

Figure 10:
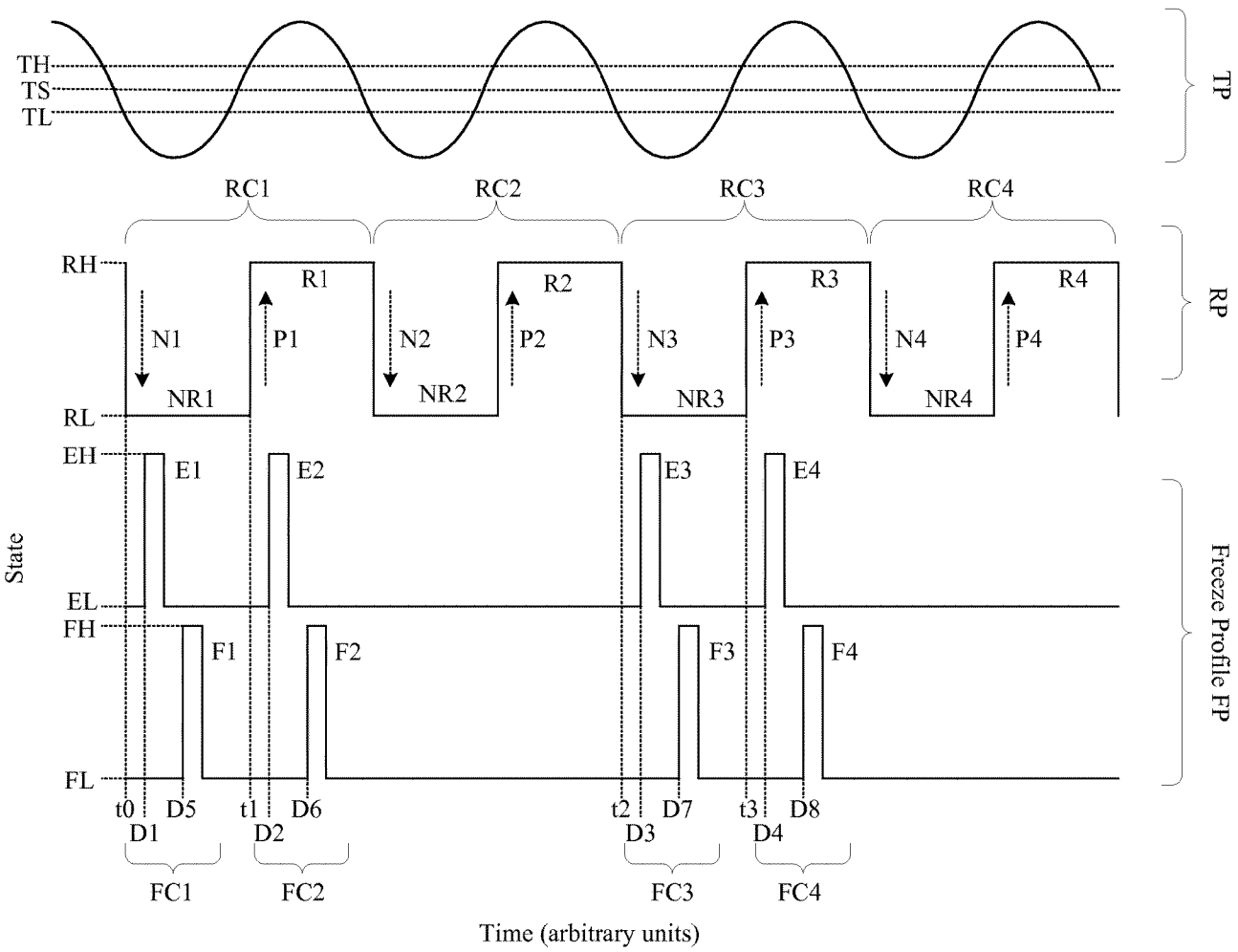
FIGS. 10, 11, 12, 13, 14 and 15 show graphs of state versus time for a plurality of fill cycles constrained with a plurality of refrigeration cycles.

In an embodiment, as shown in FIG. 10, freeze profile FP includes a plurality of fill cycles (FC1, FC2, FC3, FC4) constrained to a plurality of refrigeration cycles (RC1, RC3). Here, first fill cycle FC1 occurs during first non-refrigeration period NR1 to be asynchronous with first refrigeration period R1, and second fill cycle FC2 occurs during first refrigeration period R1 to be synchronous with first refrigeration period R1. Subsequent thereto, third freeze cycle FC3 occurs during third non-refrigeration period NR3 to be asynchronous with a third refrigeration period R3, and fourth fill cycle FC4 occurs during third refrigeration period R3 to be synchronous with a third refrigeration period R3. It is contemplated that, in some embodiments, alternating refrigeration cycles (e.g., second refrigeration cycle RC2, fourth refrigeration cycle RC4) do not have a corresponding freeze cycle (as shown in FIG. 10). In certain embodiments, all or some alternating refrigeration cycles have a corresponding freeze cycle (not shown).

Figure 11:
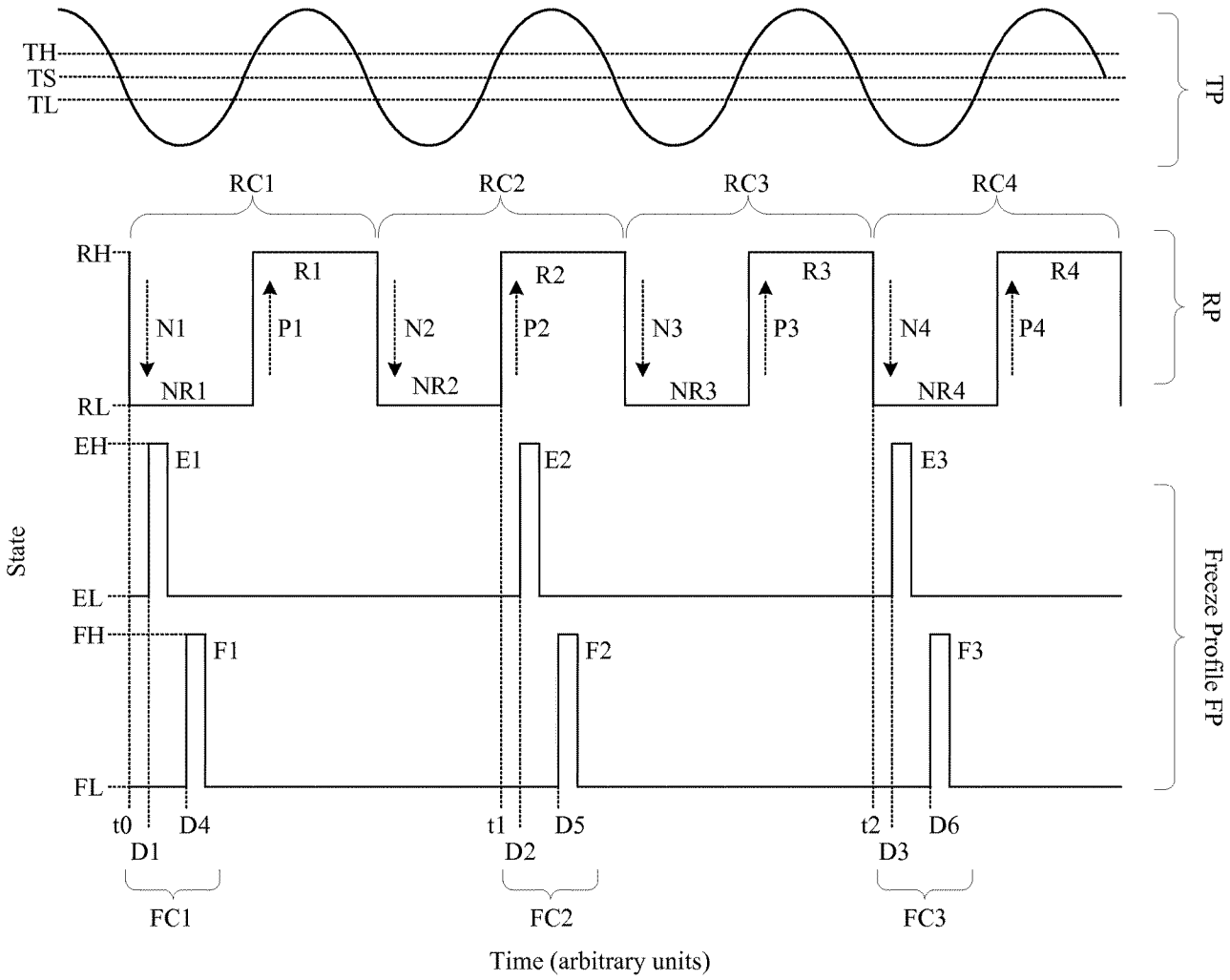

According to an embodiment, as shown in FIG. 11, freeze profile FP includes a plurality of freeze cycles (FC1, FC2, FC3) such that adjacent freeze cycles (e.g., FC1 and FC2; FC2 and FC3) are alternatingly asynchronized (e.g., FC1 occurs during first non-refrigeration period NR1; FC3 occurs during fourth non-refrigeration period NR4) and synchronized (e.g., FC2 occurs during second refrigeration period R2).

In an embodiment, as shown in FIG. 12, freeze profile FP includes a plurality of freeze cycles (FC1, FC2, FC3, FC4) constrained to a plurality of refrigeration cycles (RC1, RC3, RC3, RC4). Here, extraction period (E1, E2, E3, or E4) is asynchronously constrained to coincide with non-refrigeration period (NR1, NR2, NR3, or NR4). Further, fill period (F1, F2, F3, or F4) is synchronously constrained to coincide with (R1, R2, R3, or R4). Hence, freeze profile FP includes asynchronous extraction periods (E1, E2, E3, E4) and synchronous fill periods (F1, F2, F3, F4), wherein extraction periods (E1, E2, E3, E4) occur during non-refrigeration periods (NR1, NR2, NR3, NR4), and fill periods (F1, F2, F3, F4) occur during refrigeration periods (R1, R2, R3, R4).

Figure 13:
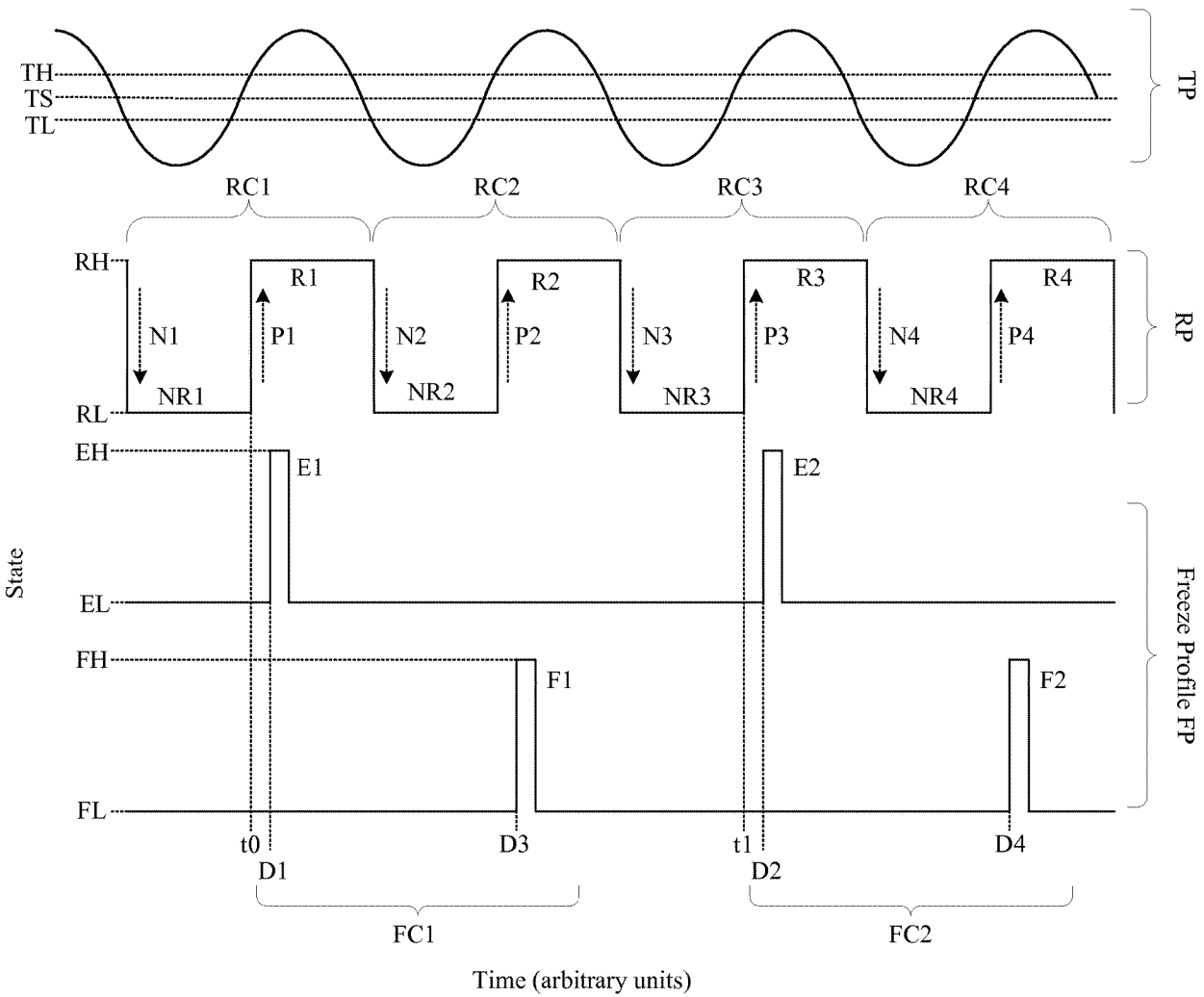

In an embodiment, as shown in FIG. 13, freeze profile FP includes a plurality of freeze cycles (FC1, FC2) such that adjacent extraction periods (E1, E2) are alternatingly synchronized with refrigeration periods (R1, R3), and adjacent fill periods (F1, F2) are alternatingly synchronized with refrigeration periods (R2, R4). Moreover, the first freeze cycle FC1 occurs during a plurality of refrigeration cycles (RC1, RC2).

Figure 14:
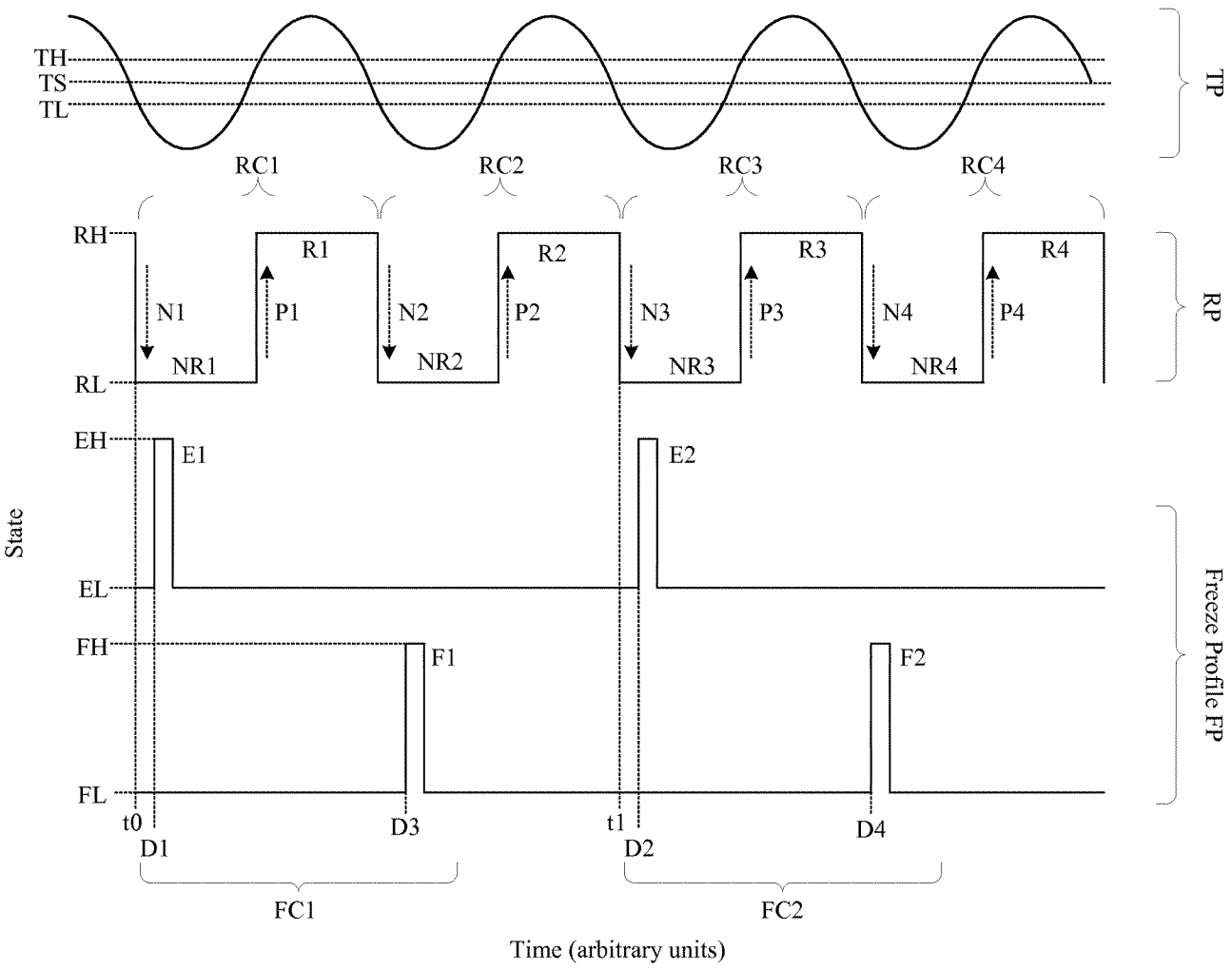

In an embodiment, as shown in FIG. 14, freeze profile FP includes a plurality of freeze cycles (FC1, FC2) such that adjacent extraction periods (E1, E2) are alternatingly asynchronized with refrigeration periods (R1, R3) to occur during non-refrigeration periods (NR1, NR3), and fill periods (F1, F2) are alternatingly asynchronized with refrigeration periods (R2, R4) to occur during non-refrigeration periods (NR2, NR4). Moreover, the first freeze cycle FC1 occurs during a plurality of refrigeration cycles (RC1, RC2) as does adjacent second freeze cycle FC2 that occurs during third refrigeration cycle RC3 and fourth refrigeration cycle RC4. Hence, freeze profile FP includes asynchronous extraction periods E1 and E2 and asynchronous fill periods F1 and F2 such that ice is extracted and fluid is provided to fluid receptacle 6 during a non-refrigeration period but not during a refrigeration period.

Figure 15:
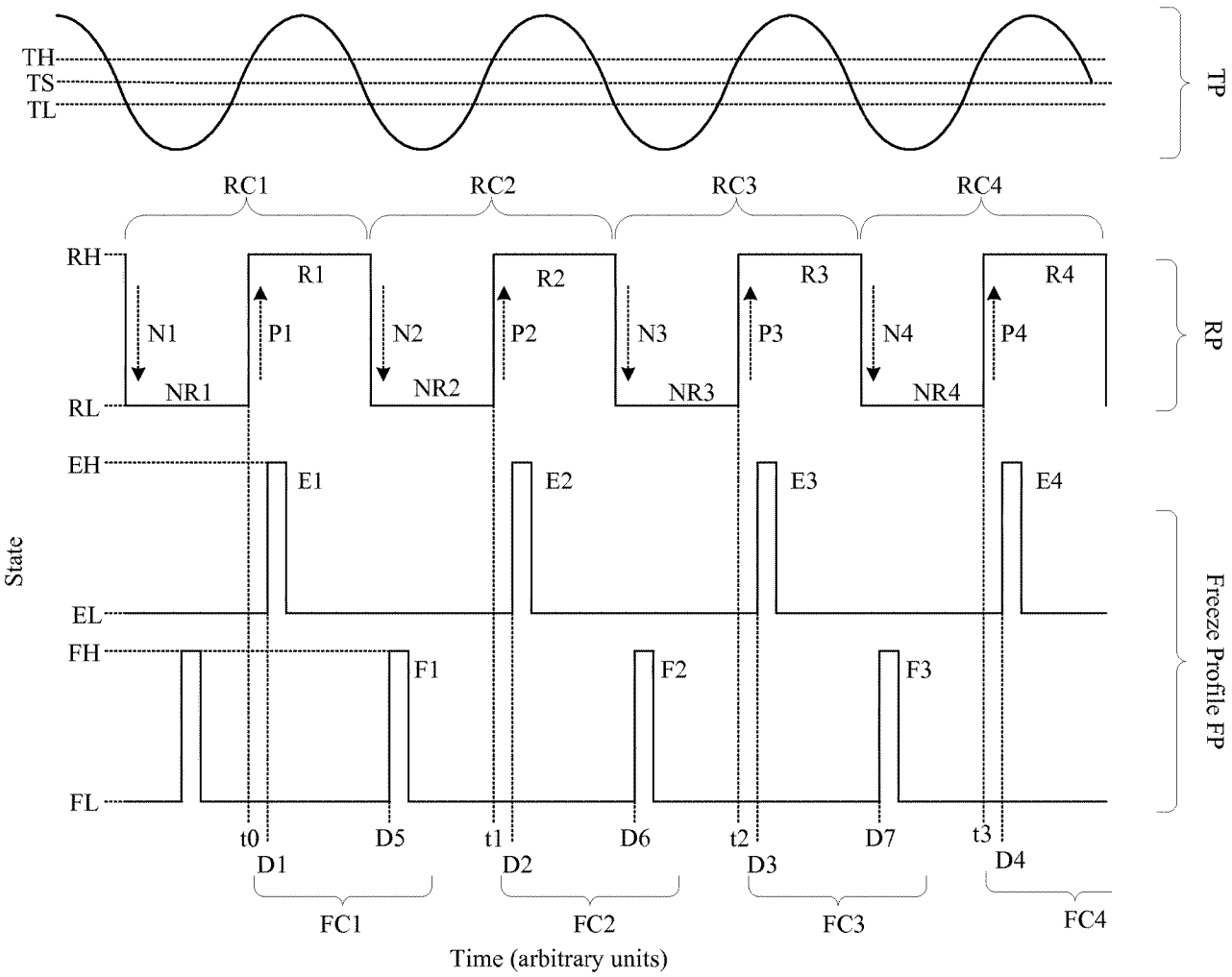

In an embodiment, as shown in FIG. 15, freeze profile FP includes a plurality of freeze cycles (FC1, FC2, FC3, FC4)

such that extraction periods (E1, E2, E3, E4) are synchronized with refrigeration periods (R1, R2, R3, R4). Fill periods (F1, F2, F3) are asynchronized with refrigeration periods (R1, R2, R3) to occur during non-refrigeration periods (NR1, NR2, NR3, NR4). Hence, freeze profile FP includes synchronous extraction periods (E1, E2, E3, E4) and asynchronous fill periods (F1, F2, F3) such that ice is extracted during refrigeration periods (R1, R2, R3, R4), and fluid is provided to fluid receptacle 6 during non-refrigeration periods (NR1, NR2, NR3, NR4) but not during a refrigeration period (R1, R2, R3, R4).

In an embodiment, a process for controlling an icemaker includes providing a freeze cycle to an icemaker, providing a refrigeration cycle to a refrigeration unit, and constraining the freeze cycle to the refrigeration cycle to control the icemaker. The freeze cycle includes an extraction period and a fill period, and the refrigeration cycle includes a non-refrigeration period and a refrigeration period. In some embodiments, constraining the freeze cycle and the refrigeration cycle includes asynchronizing the extraction period to the refrigeration period. Constraining the freeze cycle and the refrigeration cycle further can include asynchronizing the fill period to the refrigeration period. Constraining further can include synchronizing the fill period to the refrigeration period, synchronizing the extraction period to the refrigeration period, or a combination thereof. The extraction period can occur during substantially every non-refrigeration period.

In a certain embodiment, constraining the freeze cycle and the refrigeration cycle can include synchronizing the extraction period to the refrigeration period and also include synchronizing the fill period to the refrigeration period. In a certain embodiment, constraining further includes asynchronizing the fill period to the refrigeration period.

The process additionally can include constraining the refrigeration cycle to a temperature profile of the refrigeration unit, wherein the temperature profile comprises a high temperature level and a low temperature level. Constraining the refrigeration cycle to the temperature profile of the refrigeration unit can include synchronizing the refrigeration period to the high temperature level and synchronizing the non-refrigeration period to the low temperature level.

In an embodiment, controller 20 includes control logic for controlling refrigeration system 12 on and off to maintain a temperature inside refrigeration unit 4 around set temperature TS. According to an embodiment, system 2 is configured so that refrigeration system 12 cools refrigeration unit 4 substantially all operating time it is configured to function in a part-load condition to maintain a fixed cabinet temperature. Here, controller 20 is configured to include control logic based on, e.g., a temperature inside refrigeration unit 4 as feedback to vary a speed of compressor 14. Controller 20 include various functionalities to effect control of components of system 2 (e.g., icemaker 5, fluid receptacle 6, extractor 7, compressor 14, fan 16, fluid source 18, and the like). Exemplary functionalities include a microprocessor, mechanical switch, solid-state switch, proportional-integral-derivative (PID) member, and the like.

Figure 16:
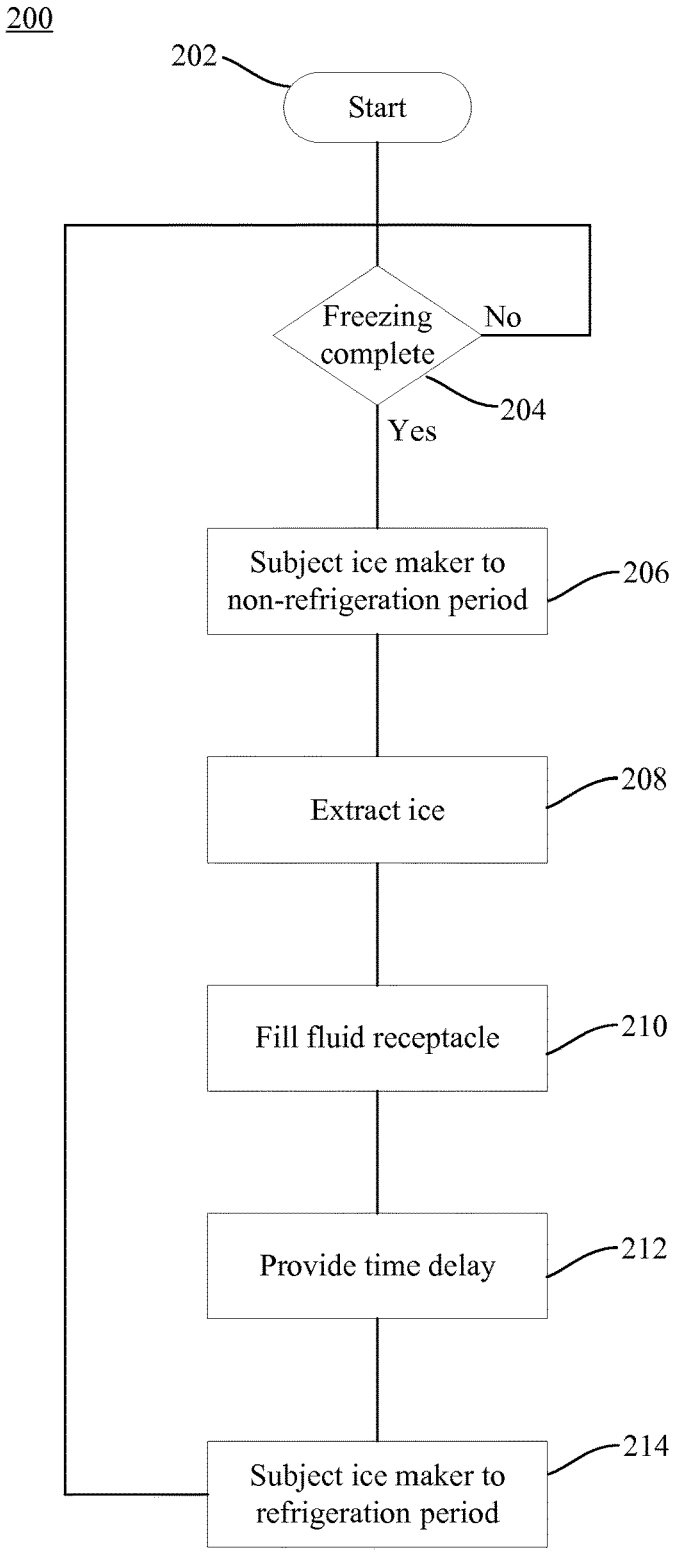
FIG. 16 shows a flow diagram for controlling an icemaker.

According to an embodiment, with reference to FIG. 16 (which shows a flow diagram for controlling an icemaker to make ice), a process for controlling an icemaker includes disposing a fluid to be frozen to ice in fluid receptacle 6, subjecting icemaker 5 to refrigeration period RP, and determining whether freezing of the fluid is complete (step 204). If freezing is incomplete, icemaker 5 is further subjected to refrigeration period RP. When freezing is determined to be complete, icemaker 5 is subjected to non-refrigeration period (step 206). Ice is extracted from fluid receptacle 6 (step 208), and fluid is provided to and disposed in fluid receptacle 6 (step 210). Thereafter, the time delay is applied to freeze profile FP (step 212), and, after the time delay, icemaker 5 is subjected to refrigeration period RP (step 214). The process repeats by determining whether freezing of the fluid is complete (step 204).

In an embodiment, a fluid is frozen when it has changed from a liquid phase to a solid phase. As such, freezing is complete when all fluid in the receptacle has changed to a solid phase. It is contemplated that determining whether freezing is complete is accomplished by measurement of the temperature of an object or surface that is indicative of the fluid temperature in the receptacle, such as the surface of receptacle, using a temperature sensor such as a thermocouple, RTD, or similar. Freezing is determined to be complete when the measured temperature is below that which the fluid in the receptacle changes phase between liquid and solid.

Figure 17:
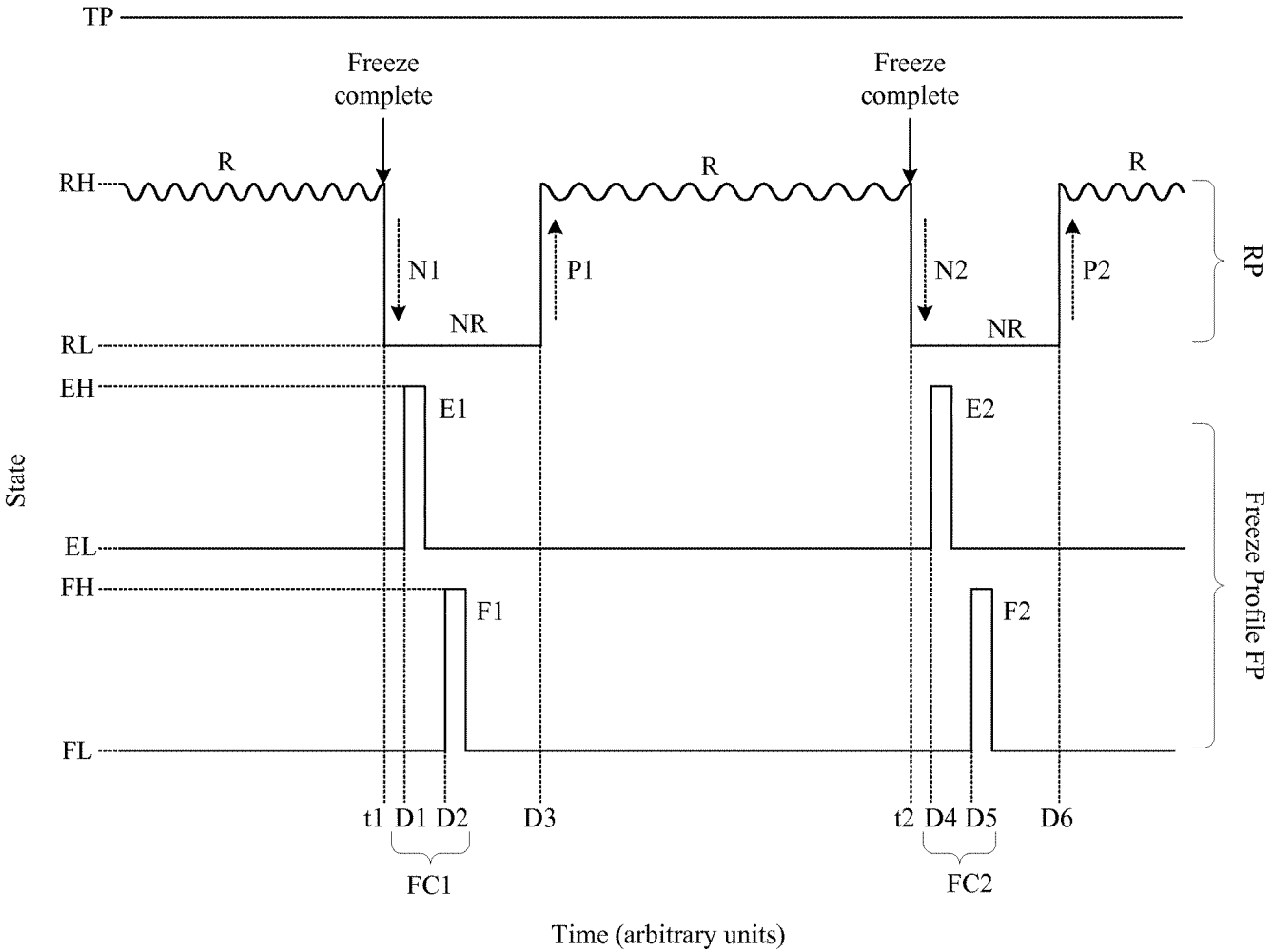
FIG. 17 shows a graph of state versus time for a refrigeration profile that is constrained to a freeze cycle.

As shown in FIG. 17, a process for controlling icemaker 5 to make ice includes subjecting icemaker 5 to refrigeration profile RP and a freeze profile FP. Refrigeration profile RP includes refrigeration low level RL and refrigeration high level RH that respectively coincide with non-refrigeration period NR and refrigeration period R. Fluid disposed in fluid receptacle 6 is completely frozen at time t1, and refrigeration profile RP has a first negative transition N1 from RH to RL to start non-refrigeration period NR. First freeze cycle FC1 occurs during non-refrigeration period NR such that ice is extracted from fluid receptacle 6 of icemaker 5 during first extraction period E1, and fluid is disposed in fluid receptacle 6 during first fill period F1. After third time delay D3, refrigeration profile RP has a first positive transition from RL to RH to begin refrigeration period R that lasts until fluid in fluid receptacle 6 is completely frozen at time t2. At time t2, non-refrigeration period NR begins as refrigeration profile RP has a second negative transition N2 from RH to RL. During non-refrigeration period NR, ice is extracted from fluid receptacle 6 of icemaker 5 during second extraction period E2, and fluid is disposed in fluid receptacle 6 during second fill period F2. After sixth time delay D6, refrigeration profile RP has second positive transition P2 from RL to RH to begin refrigeration period R and continue with subsequent freeze cycles (not shown). In this manner, refrigeration system 12 is turned off when ice is extracted from fluid receptacle 6 and when fluid receptacle 6 is provided with fluid. Refrigeration system 12 is turned on in the absence of ice being extracted from fluid receptacle 6 or provision of fluid to fluid receptacle 6. Refrigeration high level RH is shown as an undulating curve in FIG. 17 to reflect a condition where the speed of compressor 14 varies in relation to an internal temperature of refrigeration unit 4. It is contemplated that refrigeration high level RH may be constant.

The articles and processes herein have advantageous benefits and uses. According to an embodiment, an icemaker can be controlled to make ice efficiently by constraining a timing of icemaker and compressor events in order to minimize a thermodynamic loss. Further, extraction of ice can occur when the compressor or fan is not operating or operating at a low-speed. Additionally, fluid can be introduced in the fluid receptacle when compartment 10 is at or near a maximum temperature during operation. The processes can be implemented in various ways depending on hardware or control logic.

Advantageously, events associated with the making ice are constrained to be synchronous or asynchronous with events associated with operation of a refrigerating appliance (e.g., a compressor and the like) within which the icemaker is disposed. Processes herein can be implemented by providing controllers that constrain extracting ice or filling a fluid receptacle to a refrigeration profile subjected to an icemaker to result in a significant reduction in energy consumption attributed to the icemaker.

Without wishing to be bound by theory, it is believed that energy efficiency of making ice is improved if heat transfer irreversibility is minimized. Transferring heat between two bodies at different temperatures is irreversible. For a smaller a difference in temperature between the two bodies, the less a process is irreversible. Processes herein provide for transferring heat between the icemaker and its environment at a lowered temperature difference between the icemaker and its surroundings (e.g., an interior of refrigeration unit 4), resulting in an improved efficiency of the icemaker.

An efficiency with which heat is transferred from the fluid in the fluid receptacle and extracted by the refrigeration system can be inferred by considering an amount of entropy produced from heat transfer. The entropy generated from heat transferred through a finite temperature difference is given by formula 1 as follows:

$$\delta\dot{S} = \delta\dot{Q}\left[\frac{1}{T_2} - \frac{1}{T_1}\right] \tag{1}$$

where $\dot{Q}$ is a heat transfer rate; first temperature $T_1$ is a temperature of a warm thermal reservoir (e.g., fluid receptacle 6), and second temperature $T_2$ is a temperature of a cold thermal reservoir (e.g., a refrigerator unit 4).

First temperature $T_1$ depends on a timing of events associated with making ice, e.g., introducing fluid and to fluid receptacle 6 such that $T_1$ has a maximum value. Thereafter, the fluid has frozen into ice and is cooled below its freezing point so that $T_1$ obtains a minimum value. Second temperature $T_2$ can be a temperature of air in refrigerator unit 4, e.g., compartment 10, surrounding icemaker 5. Second temperature $T_2$ depends on a timing of events associated with operation of refrigeration system 12, e.g., compressor 14. $T_2$ can oscillate in value proximate to a set point of compartment 10 and decreases when compressor 10 is running and increases when compressor 10 is not running. Therefore, second temperature T2 has a maximum value immediately prior to compressor 10 switching on and has a minimum value prior to compressor 10 switching off.

In contrast to conventional refrigeration appliances, where making ice occurs independently of when a compressor switches on and off, certain embodiments herein constrain extracting ice from fluid receptacle 6 to a refrigeration profile subjected to, e.g., compressor 14. In a specific embodiment, extracting ice, which increases first temperature $T_1$, is constrained to be coincident with compressor 10 switching off that begins a period of increasing second temperature $T_2$.

In an embodiment, a process for making ice includes providing a refrigeration cycle to a refrigeration unit and providing a freeze cycle to an icemaker. The icemaker includes a receptacle to contain a fluid and an extractor to extract ice from the receptacle, and the freeze cycle includes an extraction period and a fill period the process further includes constraining the freeze cycle with the refrigeration cycle, disposing a fluid in the fluid receptacle during the fill period, freezing the fluid in the fluid receptacle to form an ice, and extracting the ice from the receptacle, during the extraction period, to make ice. Additionally, the process can include constraining the refrigeration cycle to a temperature profile of the refrigeration unit, the temperature profile comprising a high temperature level and a low temperature level; synchronizing the refrigeration period to the high temperature level; synchronizing the non-refrigeration period to the low temperature level; and asynchronizing the freeze cycle to the refrigeration cycle. In a certain embodiment, the process includes constraining the refrigeration cycle to a temperature profile of the refrigeration unit, the temperature profile comprising a high temperature level and a low temperature level; synchronizing the refrigeration period to the high temperature level; synchronizing the non-refrigeration period to the low temperature level; and synchronizing the freeze cycle to the refrigeration cycle.

The probes and processes herein further are illustrated by the following examples, which are non-limiting.

EXAMPLES

Example 1. Operating Icemaker Asynchronous to Compressor

A commercially available residential refrigerator having an automatic icemaker disposed in a freezer compartment separated by an insulating wall from another cooling compartment was used to determine an amount of energy consumed during making ice. Here, the icemaker had a lever arm to detect whether an ice storage bin was full. In conventional operation, the lever arm would be maintained in a lower position, and the icemaker would continually operate to make ice by filling an ice receptacle with water, allowing the water to freeze and form ice, (after freezing) heating the ice receptacle to melt a small portion of ice in contact with the ice receptacle, removing the ice from the ice receptacle, and disposing the ice in the ice storage bin. The icemaker would continue to make ice until, due to accumulation of ice in the ice storage bin, the lever arm would reposition to an upper position to discontinue filling the ice receptacle with water, heating the ice receptacle, and removing the ice from the ice receptacle.

In contrast to the conventional operation, during testing, the icemaker was modified to constrain the operation of the icemaker with operation of the compressor. Specifically, a string was attached to the lever arm to control the position of the lever arm regardless of an amount of ice in the ice storage bin. Instead, the icemaker was controlled to operate asynchronously with the compressor. That is, when the compressor was operated to actively lower a temperature of the freezer compartment, the string was used to position the lever arm in the upper position to discontinue filling the ice receptacle with water, heating the ice receptacle, and removing the ice from the ice receptacle. However, when the compressor was not operated and did not actively lower a temperature of the freezer compartment, the string was used to position the lever arm in the lower position to allow the ice maker to heat the ice receptacle, remove the ice from the ice receptacle, and fill the ice receptacle with water, subject to the constraints of its normal cycle. To fill the ice receptacle with water, a solenoid valve that was connected to a water source was opened until the ice receptacle was filled with water at which time the solenoid valve was closed.

Figure 18:
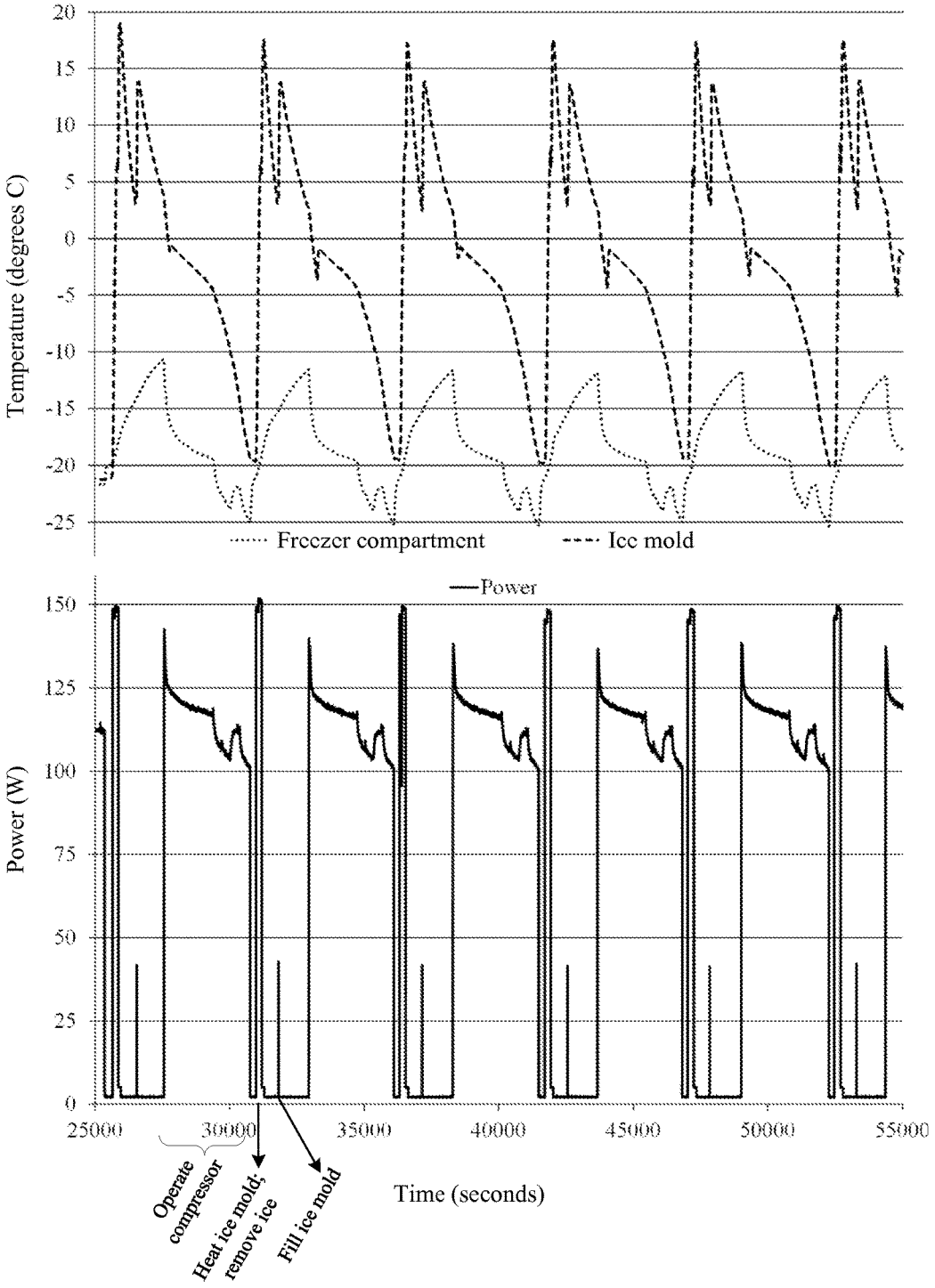
FIG. 18 shows a graph of temperature and power versus time for a system that includes a refrigeration unit and an icemaker wherein freeze cycles are synchronous with refrigeration cycles according to Example 1.
Figure 19:
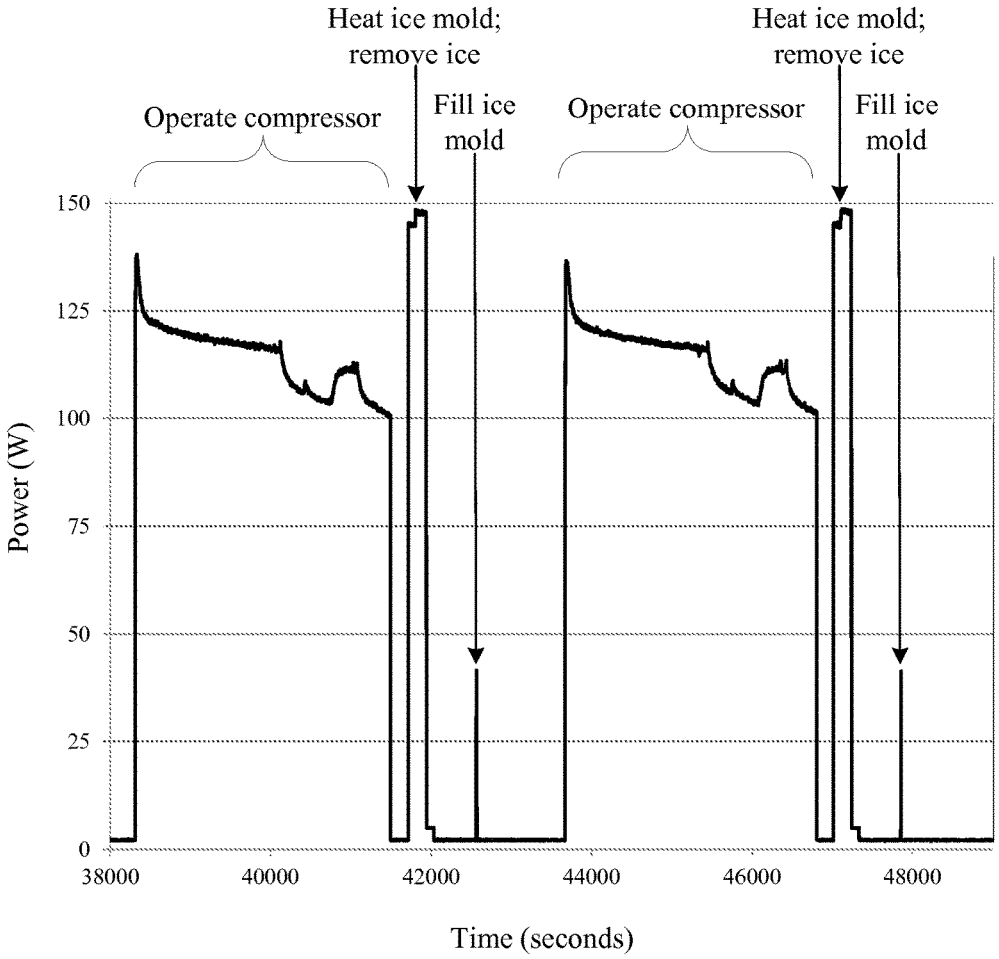
FIG. 19 shows a graph of power versus time for the system according to Example 1.

Power consumption and temperatures of the refrigerator were acquired. FIG. 18 shows a graph of the temperatures (upper panel) of the freezer compartment (dotted curve) and ice receptacle (dashed curve) and power consumed (lower panel, solid curve) versus time. The data show the asynchronicity in timing of filling and removing ice from the ice receptacle with respect to operation of the compressor. A portion of the lower panel of FIG. 18 is shown enlarged in FIG. 19 to indicate more clearly when the compressor operated with respect to heating the ice receptacle, removing ice from the ice receptacle, and filling the ice receptacle. Peak power consumption was less than 150 watts (W) that occurred during heating the ice receptacle. During asynchronous operation of the icemaker, ice was produced at an average rate of 60.8 grams per hour with consumption of 236 watt hours (Wh) of energy per kilogram of ice produced, which was a 15.3% reduction in energy consumption compared to conventional operation of the icemaker (see Example 3).

Example 2. Operating Icemaker Synchronous with Compressor

The refrigerator having the icemaker modified per Example 1 was used except the icemaker was operated synchronously with operation of the compressor. That is, when the compressor was on to actively cool the freezer compartment, the ice receptacle was heated to remove ice from the ice receptacle with subsequent filling of the ice receptacle with water. When the compressor was not operated, the ice receptacle was not heated nor was ice removed from the ice receptacle so that the ice receptacle was not subjected to being filled with water by operation of the solenoid valve.

Figure 20:
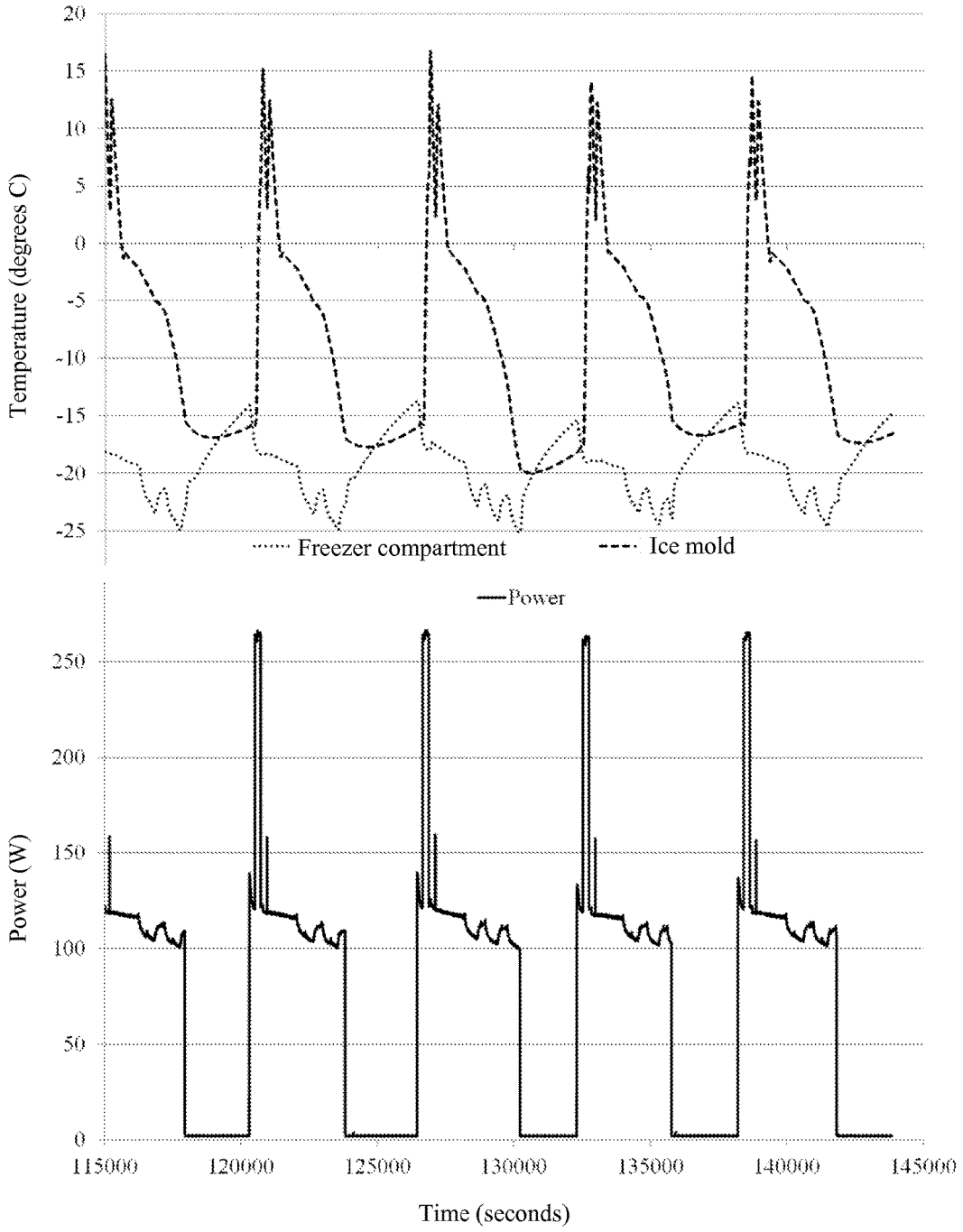
FIG. 20 shows a graph of temperature and power versus time for a system that includes a refrigeration unit and an icemaker wherein freeze cycles are asynchronous with refrigeration cycles according to Example 2.
Figure 21:
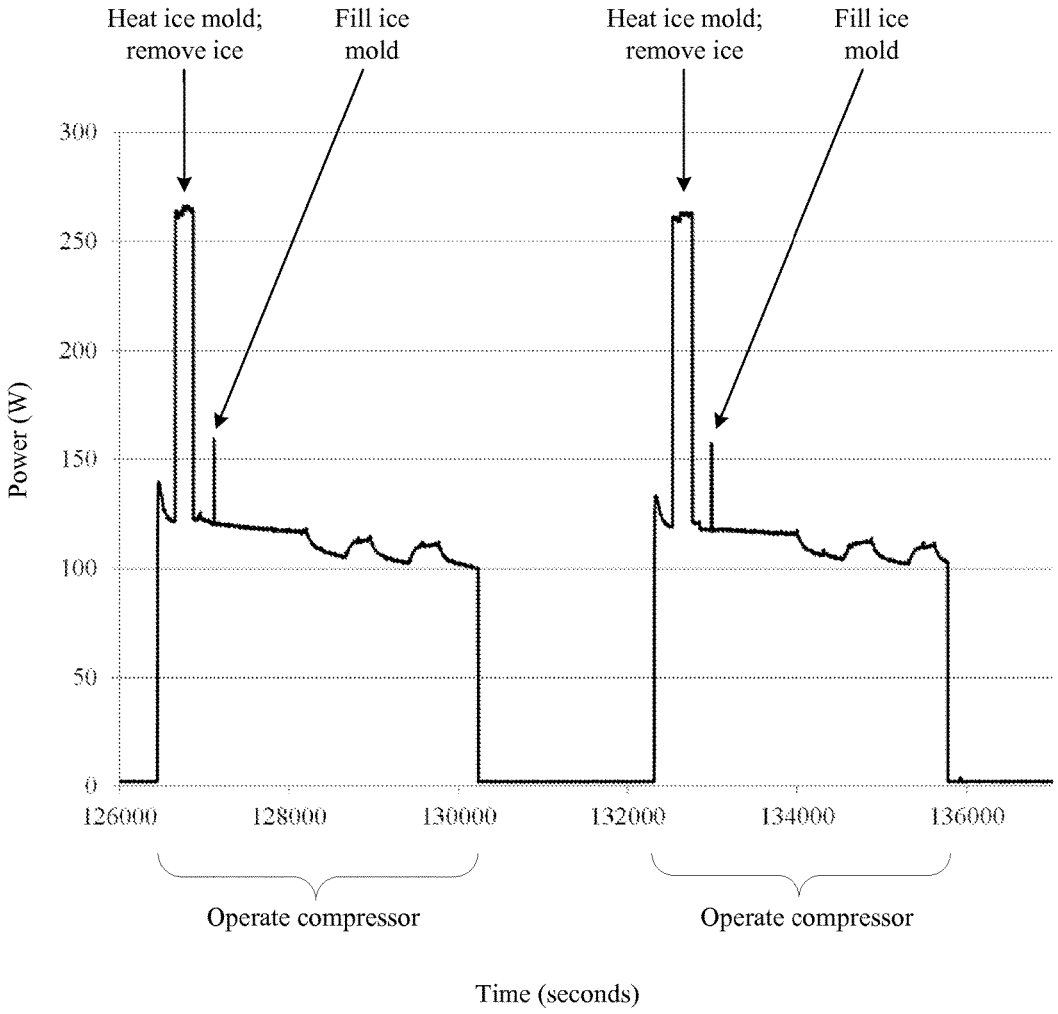
FIG. 21 shows a graph of power versus time for the system according to Example 2.

The temperatures of the ice receptacle and freezer compartment as well as the power of the refrigeration unit were acquired during synchronous operation. FIG. 20 shows a graph of the temperatures and power versus time. A portion of the lower panel of FIG. 20 is shown enlarged in FIG. 21 to indicate more clearly when the compressor operated with respect to heating the ice receptacle, removing ice from the ice receptacle, and filling the ice receptacle. Peak power consumption was less than 275 watts (W) that occurred during heating the ice receptacle to coincide with operation of the compressor. During synchronous operation of the icemaker, ice was produced at an average rate of 55.3 grams per hour with consumption of 254 Wh of energy per kilogram of ice produced, which was a 6.9% reduction in energy consumption compared to conventional operation of the icemaker (see Example 3).

Comparing the results from asynchronous operation (Example 1) and synchronous operation (Example 2) shows that when heating ice receptacle or introducing water into the ice receptacle was delayed until after the compressor switched off, the refrigerator consumed 7.8% less energy and produced ice 9.8% faster than when these steps were coincident with the compressor being on.

Example 3. Operating Icemaker Independent of Compressor

The refrigerator having the icemaker modified per Example 1 was used except the icemaker was operated in a conventional manner such that heating the ice receptacle, removing ice from the ice receptacle, and filling water in the ice receptacle were performed independent of when the compressor was cooling the freezer compartment or not to cooling the freezer compartment.

Figure 22:
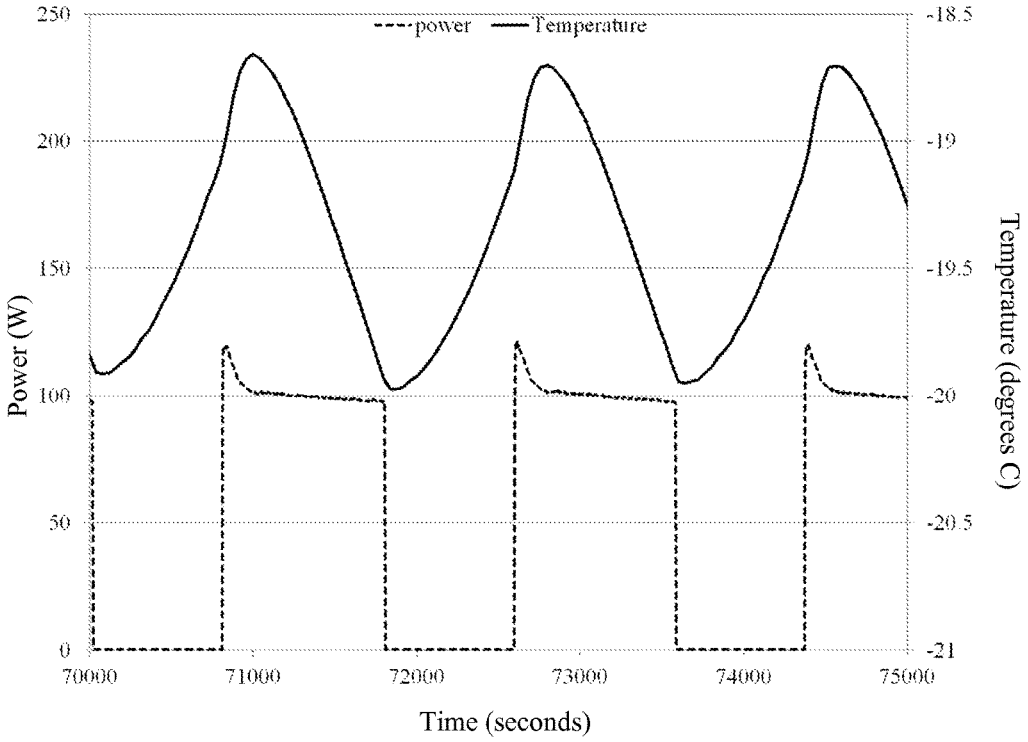
FIG. 22 shows a graph of power and temperature versus time for a refrigeration unit wherein a refrigeration profile is constrained with a temperature profile according to Example 3.

In a first test, the refrigerator maintained a temperature range near a set point inside its cabinet by intermittently operating the refrigerator's vapor compression system and associated fans. These components turned on when the cabinet temperature reached a certain threshold above a set point temperature and lowered the temperature of the freezer until it reached a threshold below the set point. The temperature inside the cabinet increased when the components were not operating due to heat absorption through the insulated walls of the cabinet. FIG. 22 shows a graph of power versus time for steady-state operation of the refrigerator where the refrigerators electrical power draw is shown as a dashed curve, and the freezer compartment temperature is shown is a solid curve.

Figure 23:
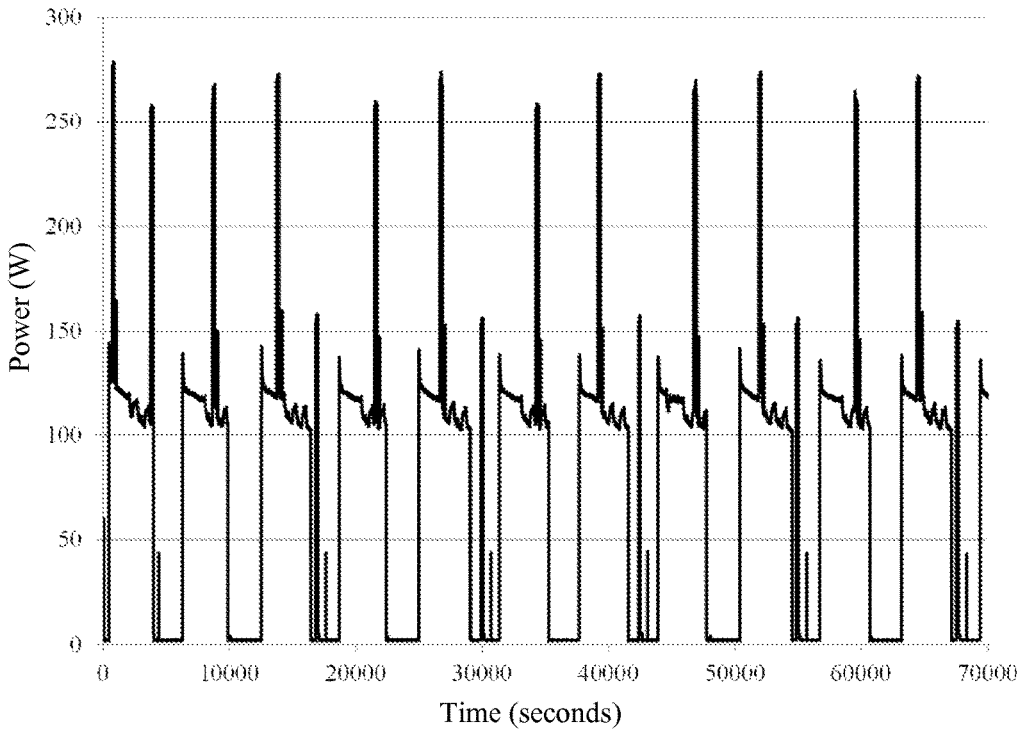
FIG. 23 shows a graph of power versus time for the system according to Example 3 wherein the freeze profile is independent of the refrigeration profile.

In a second test, the icemaker was operated independently (i.e., not constrained to the compressor) of the compressor such that whenever the water was frozen in the ice receptacle, the ice receptacle was heated; the ice was removed from the ice receptacle; and the ice receptacle was refilled with water regardless of whether the compressor was off or on. FIG. 23 shows a graph of power versus time for the refrigerator. When the icemaker heater operated to heat the ice receptacle, large spikes appeared in power draw. In addition, ice was moved approximately three times per two compressor cycles. Operating icemaker independent of the compressor produced ice at an average rate of 77.2 grams per hour and consumed 272 Wh of energy per kilogram of ice produced.

Table 1 shows a summary of results data from Example 1, Example 2, and Example 3.

TABLE 1

| Example | Production rate (grams ice/hour) | Energy consumption (Wh/kg ice) |
|---|---|---|
| 1 | 60.8 | 236 |
| 2 | 55.3 | 254 |
| 3 | 77.2 | 272 |

While one or more embodiments have been shown and described, modifications and substitutions may be made thereto without departing from the spirit and scope of the invention. Accordingly, it is to be understood that the present invention has been described by way of illustrations and not limitation. Embodiments herein can be used independently or can be combined.

All ranges disclosed herein are inclusive of the endpoints, and the endpoints are independently combinable with each other. The ranges are continuous and thus contain every value and subset thereof in the range. Unless otherwise stated or contextually inapplicable, all percentages, when expressing a quantity, are weight percentages. The suffix "(s)" as used herein is intended to include both the singular and the plural of the term that it modifies, thereby including at least one of that term (e.g., the colorant(s) includes at least one colorants). "Optional" or "optionally" means that the subsequently described event or circumstance can or cannot occur, and that the description includes instances where the event occurs and instances where it does not. As used herein, "combination" is inclusive of blends, mixtures, alloys, reaction products, and the like.

As used herein, "a combination thereof" refers to a combination comprising at least one of the named constituents, components, compounds, or elements, optionally together with one or more of the same class of constituents, components, compounds, or elements.

All references are incorporated herein by reference.

The use of the terms "a" and "an" and "the" and similar referents in the context of describing the invention (especially in the context of the following claims) are to be construed to cover both the singular and the plural, unless otherwise indicated herein or clearly contradicted by context. "Or" means "and/or." It should further be noted that the terms "first," "second," "primary," "secondary," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity). The conjunction "or" is used to link objects of a list or alternatives and is not disjunctive; rather the elements can be used separately or can be combined together under appropriate circumstances.

What is claimed is:

1. A process for controlling an icemaker, the process comprising:

providing a freeze cycle to the icemaker, the freeze cycle comprising:

an extraction period; and a fill period;

providing a refrigerator cycle to a refrigerator unit, the refrigerator cycle comprises:

a non-refrigeration period, the non-refrigeration period being asynchronous to a compressor for the icemaker such that the compressor is off during the non-refrigeration period; and a refrigeration period, the refrigeration period being synchronous to the compressor for the icemaker such that the compressor is on during the refrigeration period;

constraining the freeze cycle to the refrigeration cycle to control the icemaker;

asynchronizing the extraction period to the refrigeration period;

asynchronizing the fill period to the refrigeration period; and constraining the refrigeration cycle to a temperature profile of the refrigeration unit, wherein the temperature profile comprises a high temperature level and a low temperature level.

2. The process of claim 1, wherein the extraction period occurs during every non-refrigeration period.

3. The process of claim 1, wherein constraining the refrigeration cycle to the temperature profile of the refrigeration unit comprises:

synchronizing the refrigeration period to the high temperature level; and synchronizing the non-refrigeration period to the low temperature level.

* * * * *